US005722446A

United States Patent [19]

Zheng

[11] Patent Number: 5,722,446

[45] Date of Patent: Mar. 3, 1998

[54] COLLAPSIBLE STRUCTURES

[75] Inventor: Yu Zheng, Covina, Calif.

[73] Assignee: Patent Category Corp., Monrovia, Calif.

[21] Appl. No.: 778,878

[22] Filed: Jan. 2, 1997

[51] Int. Cl.[6] ..... E04H 15/40

[52] U.S. Cl. ..... 135/125; 135/97; 135/128; 135/137; 135/116; 273/402; 273/397; 473/433; 446/476; 482/35

[58] Field of Search ..... 135/97, 128, 137, 135/143, 119, 116, 117, 120.3, 125; 482/35, 36, 23; 472/136; 446/476, 478; 273/402, 394, 395, 396, 397, 398; 473/431–435, 472, 481

[56] References Cited

U.S. PATENT DOCUMENTS

| | | | |
|---|---|---|---|
| 3,201,126 | 8/1965 | Nissen | 273/402 X |
| 3,663,346 | 5/1972 | Schoen | 482/35 X |
| 3,960,161 | 6/1976 | Norman . | |
| 3,990,463 | 11/1976 | Norman . | |
| 4,063,725 | 12/1977 | Snyder | 482/35 |
| 4,301,766 | 11/1981 | Piccone | 482/35 X |
| 4,825,892 | 5/1989 | Norman . | |
| 4,858,634 | 8/1989 | McLeese . | |
| 5,038,812 | 8/1991 | Norman . | |
| 5,137,044 | 8/1992 | Brady . | |
| 5,310,176 | 5/1994 | Berg | 473/433 |
| 5,330,175 | 7/1994 | Kim | 273/397 |
| 5,343,887 | 9/1994 | Danaher | 135/137 X |
| 5,370,145 | 12/1994 | Wu . | |
| 5,393,049 | 2/1995 | Nelson | 273/402 X |
| 5,394,897 | 3/1995 | Ritchey et al. | 135/117 X |
| 5,467,794 | 11/1995 | Zheng . | |
| 5,560,385 | 10/1996 | Zheng . | |
| 5,618,246 | 4/1997 | Zheng | 482/35 |
| 5,620,396 | 4/1997 | Westphal | 482/35 |

FOREIGN PATENT DOCUMENTS

| | | | |
|---|---|---|---|
| 2635136 | 2/1990 | France . | |
| 1314295 | 4/1973 | United Kingdom | 482/35 |

*Primary Examiner*—Wynn E. Wood
*Attorney, Agent, or Firm*—Raymond Sun

[57] ABSTRACT

Collapsible structures are provided that include arcade-styled games for the fun and entertainment of both adults and children. These collapsible structures can be easily and quickly folded and collapsed into a compact configuration. The collapsible structures have at least three foldable frame members, each having a folded and an unfolded orientation. A fabric material substantially covers each frame member to form a panel for each frame member when the frame member is in the unfolded orientation, with the fabric assuming the unfolded orientation of its associated frame member.

30 Claims, 21 Drawing Sheets

COLLAPSIBLE STRUCTURES

BACKGROUND OF THE INVENTION

1. Field of the Invention

The present invention relates to collapsible structures, and in particular, to collapsible play structures which may be provided in a variety of shapes and sizes. The collapsible play structures may be twisted and folded to reduce the overall size of the play structures to facilitate convenient storage and use.

2. Description of the Prior Art

Two important considerations for all toys or play things targeted for children and adults are convenience and variety. Relating to convenience, a toy must be easily transportable so that the user can move it around the home, or even to other places outside of the home. A toy must also be easily stored since an adult or child is likely to have many other toys or objects that compete for precious storage space in the home. As for variety, a toy must offer enough variety in play so that the child or adult will be able to enjoy it for a long period of time without getting bored.

Larger toys often pose a greater problem with regards to convenience. The larger toys tend to be bulky, which makes it difficult to move them around the home, and sometimes makes it prohibitive to move them outside the house to other locations. Bulky toys also take up much storage space. For these reasons, many executive toys targeted for adults are made in small sizes.

Collapsible play structures have recently become popular with both adults and children. Examples of such structures are shown and described in U.S. Pat. Nos. 5,038,812 (Norman), 5,467,794 (Zheng) and 5,560,385 (Zheng). These structures may be twisted and folded to reduce the overall size of the structures to facilitate convenient storage and use. As such, these structures are being enjoyed by many people in many different applications.

For example, these structures have been provided in many different shapes and sizes for children's play inside and outside the house. Smaller versions of these structures have been used as infant nurseries. Even smaller versions of these structures have been used as dollhouses and action figure play houses by toddlers and children.

As another example, these structures have been made into tents or outdoor structures that can be used by adults and children for camping or other outdoor purposes. These structures have also been popular as beach cabanas.

Even animals can enjoy these structures. Some of these structures have been made into shelters that can be used by pets, both inside and outside the house.

The wide-ranging uses for these collapsible structures can be attributed to the performace, convenience and variety that these structures provide. When fully expanded, these structures are stable and can be used as a true shelter without the fear of collapse. These structures are easily twisted and folded into a compact configuration to allow the user to conveniently store the structure. The light-weight nature of the materials used to make these structures makes it convenient for them to be moved from one location to another. These structures also provide much variety in use and enjoyment. For example, a child can use a structure both indoors and outdoors for different play purposes, and can use the same structure for camping.

However, these collapsible structures have been primarily used to shelter individuals, animals, and objects, and to allow individuals or animals to crawl therethrough. The present invention provides different applications for these collapsible structures, thereby increasing the variety of play, entertainment value, and utility for such structures.

SUMMARY OF THE DISCLOSURE

The present invention provides a collapsible structure that includes arcade-styled games for the fun and entertainment of both adults and children. These collapsible structures can be easily and quickly folded and collapsed into a compact configuration. As a result, the collapsible structures according to the present invention are convenient to use, to move around, and to store, thereby making them ideal for use at home, at the office as an executive toy, and at many other locations.

In order to accomplish the objects of the present invention, the collapsible structure according to the present invention has at least three foldable frame members, each having a folded and an unfolded orientation. A fabric material substantially covers each frame member to form a panel for each frame member when the frame member is in the unfolded orientation, with the fabric assuming the unfolded orientation of its associated frame member.

In one embodiment of the present invention, the structure has a top fabric connected to the panels and extending therebetween, and having a first opening. The top fabric may be attached to the panels at locations offset from the top edge of the panels. The top fabric may also be slanted such that its attachment to a rear panel is at a higher vertical level than its attachment to the front panel. The structure includes a front panel and two side panels, with the front panel having a first opening. The structure further includes a tube or netting having opposing ends connected to the first opening in the front panel and the first opening of the top fabric.

Further in accordance with the present invention, each panel and its frame member has a left side, a right side, and a bottom side connecting the left side and the right side, with the bottom side of each side panel adapted to rest on a surface to support the play structure. The left side of each panel is hingedly connected to the right side of an adjacent panel, and the right side of each panel is hingedly connected to the left side of another adjacent panel.

The structure according to the present invention may also include a first rear panel and a basket attached to the interior surface of the first rear panel and aligned with the first opening of the top fabric such that a ball that passes through the basket will be directed through the first opening of the top fabric.

The structure according to the present invention may also include an upper opening in the front panel, and a second opening in the top fabric which communicates with the tube or netting.

In another embodiment according to the present invention, the structure includes a second rear panel attached to the two side panels, with the first rear panel removably attached to the second rear panel. A support panel is attached to the first and second rear panels and a side panel to support the rear panels in their vertical position.

In yet another embodiment according to the present invention, the structure includes a tube connected to the first opening in the front panel and a funnel attached to a rear panel and connected to the tube. The funnel has a front edge coupled to the tube, and a ramp which slopes downwardly from its rear edge to its front edge. The structure according to this embodiment includes the front panel, the rear panel, a front left side panel connected to the front panel, a front right side panel connected to the front panel, a rear left side panel connected to the rear panel, and a rear right side panel connected to the rear panel. The front left side panel and the rear left side panel are connected to each other, and the front right side panel and the rear right side panel are connected to each other. A support panel may also be connected to the connections between the front left side panel and the rear left side panel, and the front right side panel and the rear right side panel. The support panel has a window which is connected to the tube and the front edge of the ramp.

In a further embodiment according to the present invention, the structure includes a board having an edge hingedly connected to the exterior surface of the front panel, and elastic tie members for supporting the board in a position which is substantially horizontal to the surface, with the elastic tie members operating to bias the board back to the substantially horizontal position after the board has been pressed and released.

In yet another embodiment according to the present invention, the structure includes a basket attached to the exterior surface of one panel. A trough may be provided in one panel, so that a ball tossed through the trough will deposit inside the structure. An opening may be provided in a panel for ingress and egress to the interior of the structure.

In another embodiment according to the present invention, the structure includes a tube having a first end connected to an exterior surface of the rear panel adjacent an opening of the rear panel, and extending through the interior of the structure with a second end connected to an opening of the front panel. A flap may be hingedly connected at the opening of the rear panel, and a pad may be hingedly attached to the exterior surface of the rear panel and attached to the first end of the tube.

In yet a further embodiment according to the present invention, the structure includes a rear panel having a first side and an opposing second side, a first front panel and two first side panels attached to the first side of the rear panel, and a second front panel and two second side panels attached to the second side of the rear panel, with the first front panel and the second front panel each having an opening. A first top fabric is connected to the panels on the first side of the rear panel and extending therebetween, and a second top fabric is connected to the panels on the second side of the rear panel and extending therebetween, with the first and second top fabrics each having an opening. A first basket may be attached to the first side of the rear panel and substantially aligned with the opening of the first top fabric, and a second basket may be attached to the second side of the rear panel and substantially aligned with the opening of the second top fabric. The structure further includes means for coupling one of the openings of the first top fabric or the second top fabric with the opening of the first front panel.

In one embodiment, the means for coupling one of the openings of the first top fabric or the second top fabric with the opening of the first front panel includes a guide positioned at the opening of the first top fabric, and a first tube having one end connected to the opening of the first front panel and having an opening for receiving the guide. In another embodiment, the means for coupling one of the openings of the first top fabric or the second top fabric with the opening of the first front panel has a guide positioned at the opening of the second top fabric, and a first tube having one end connected to the opening of the first front panel and an opposing end for receiving the guide.

The structure according to this embodiment may also include means for coupling one of the openings of the first top fabric or the second top fabric with the opening of the second front panel. In one embodiment, the means for coupling one of the openings of the first top fabric or the second top fabric with the opening of the second front panel includes a guide positioned at the opening of the second top fabric, and a second tube having one end connected to the opening of the second front panel and having an opening for receiving the guide. In another embodiment, the means for coupling one of the openings of the first top fabric or the second top fabric with the opening of the second front panel includes a guide positioned at the opening of the first top fabric, and a second tube having one end connected to the opening of the second front panel and an opposing end for receiving the guide.

When the collapsible structures are to be folded and collapsed for storage, the panels and their corresponding frame members may be folded against each other about the hinged connections to have the panels and frame members overlying each other. The overlying panels and frame members are then collapsed by twisting and folding to form a plurality of concentric frame members and panels to substantially reduce the size of the structure.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

The collapsible structures according to the present invention are provided in the form of arcade games which can be enjoyed by both children and adults. These structures can be folded and collapsed into a compact configuration for convenient storage and transportation.

Figure 1:
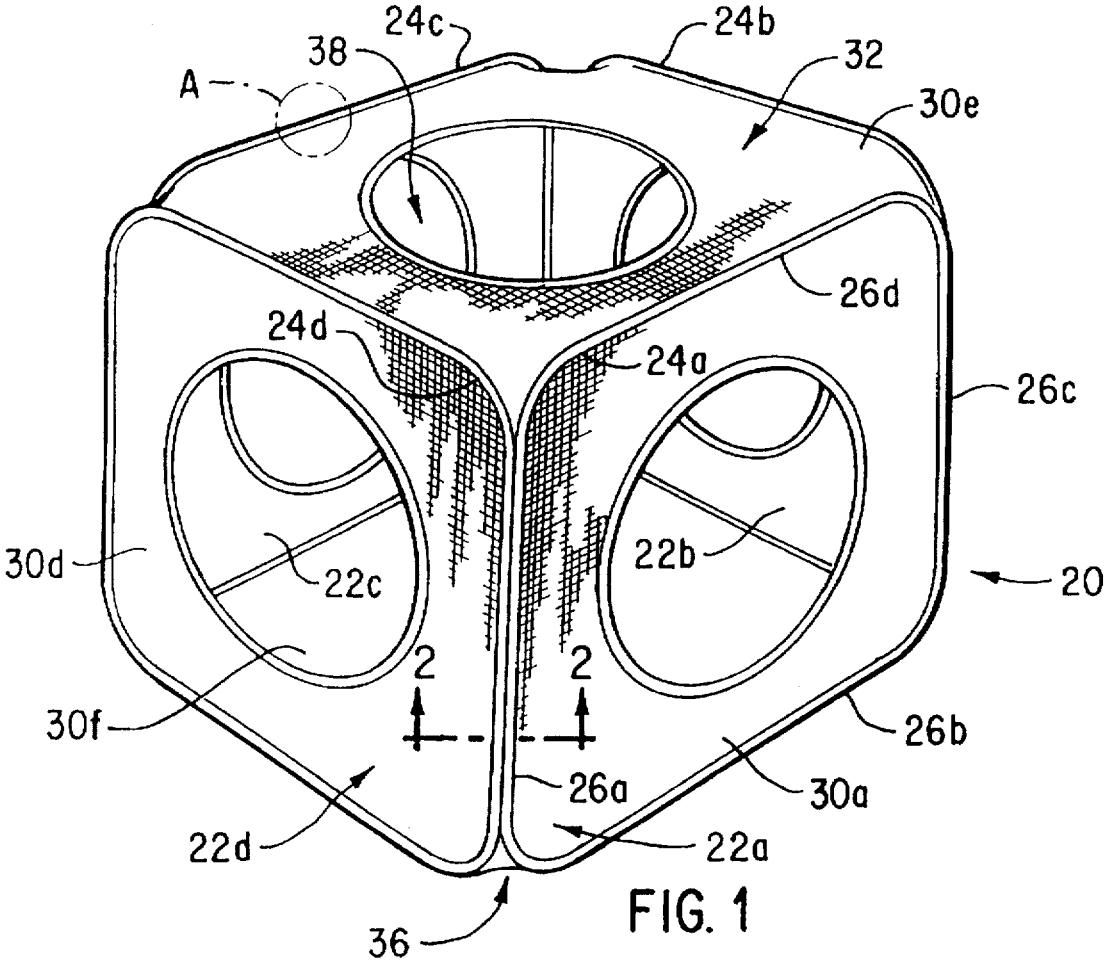
FIG. 1 is a perspective view of one module of a collapsible structure according to a first preferred embodiment of the present invention.
Figure 1A:
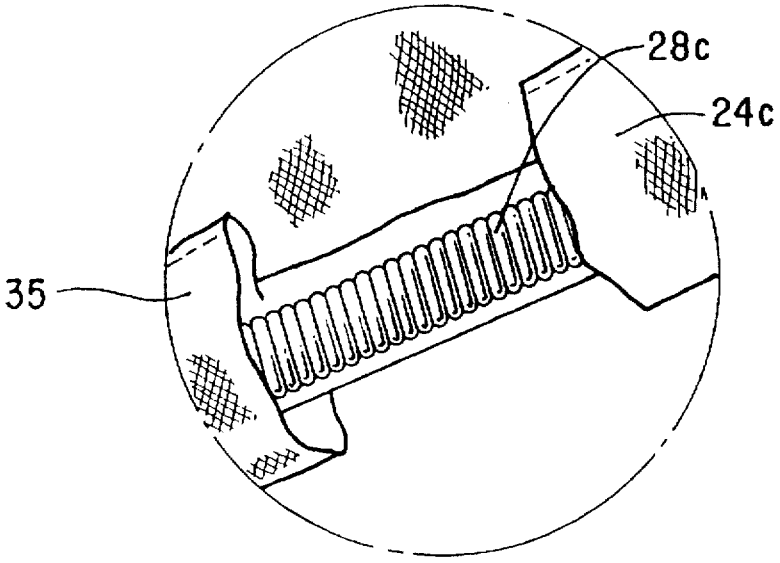
FIG. 1A is a partial cut-away view of the section A of the structure of FIG. 1 illustrating a frame member retained within a sleeve.

As shown in FIGS. 1 and 1A, the basic component for a collapsible structure according to the present invention comprises a module 20. As explained in greater detail hereinbelow, the collapsible structures according to the present invention are each comprised of one or more of these modules 20 assembled to create a resulting structure having the desired shape and size.

Referring to FIG. 1, according to a first preferred embodiment of the present invention, each module 20 comprises four side panels 22*a*, 22*b*, 22*c* and 22*d* connected to each other to encircle an enclosed space. Each side panel 22*a*, 22*b*, 22*c* and 22*d* has four sides, a left side 26*a*, a bottom side 26*b*, a right side 26*c* and a top side 26*d*. Each side panel 22*a*, 22*b*, 22*c* and 22*d* has a continuous frame retaining sleeve 24*a*, 24*b*, 24*c* or 24*d* provided along and traversing the four edges of its four sides 26*a*, 26*b*, 26*c* and 26*d*. A continuous frame member 28*a*, 28*b*, 28*c* or 28*d* is retained or held within each frame retaining sleeve 24*a*, 24*b*, 24*c* or 24*d*, respectively, to support each side panel 22*a*, 22*b*, 22*c* and 22*d*. Only the frame member 28*c* is shown in FIG. 1A; the other frame members 28*a*, 28*b* and 28*d* are not shown but are the same as frame member 28*c*.

The continuous frame members 28*a*, 28*b*, 28*c* and 28*d* may be provided as one continuous loop, or may comprise a strip of material connected at both ends to form a continuous loop. The continuous frame members 28*a*, 28*b*, 28*c* and 28*d* are preferably formed of flexible coilable steel, although other materials such as plastics may also be used. The frame members should be made of a material which is relatively strong and yet is flexible to a sufficient degree to allow it to be coiled. Thus, each frame member 28*a*, 28*b*, 28*c* and 28*d* is capable of assuming two positions or orientations, an open or expanded position such as shown in FIG. 1, or a folded position in which the frame member is collapsed into a size which is much smaller than its open position (see FIG. 8(E)).

Fabric or sheet material 30*a*, 30*b*, 30*c* and 30*d* extends across each side panel 22*a*, 22*b*, 22*c* and 22*d*, respectively, and is held taut by the respective frame members 28*a*, 28*b*, 28*c* and 28*d* when in its open position. The term fabric is to be given its broadest meaning and should be made from strong, lightweight materials and may include woven fabrics, sheet fabrics or even films. The fabric should be water-resistant and durable to withstand the wear and tear associated with rough treatment by children. The frame members 28*a*, 28*b*, 28*c* and 28*d* may be merely retained within the respective frame retaining sleeves 24*a*, 24*b*, 24*c* and 24*c* without being connected thereto. Alternatively, the frame retaining sleeves 24*a*, 24*b*, 24*c* and 24*d* may be mechanically fastened, stitched, fused, or glued to the frame members 28*a*, 28*b*, 28*c* and 28*d*, respectively, to retain them in position.

Figure 2A:
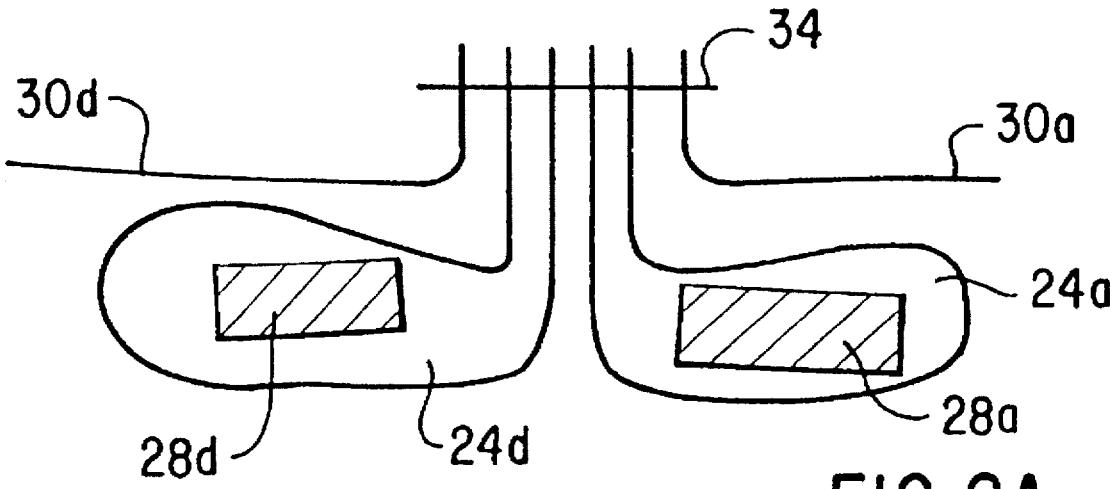
FIG. 2A is a cross-sectional view of a first preferred connection between two adjacent panels of the structure of FIG. 1 taken along line 2—2 thereof.

FIG. 2A illustrates one preferred connection for connecting adjacent edges of two side panels 22*a* and 22*d*. The fabric pieces 30*a* and 30*d* are stitched at their edges by a stitching 34 to the respective sleeves 24*a* and 24*d*. Each sleeve 24*a* and 24*d* may be formed by folding a piece of fabric. The stitching 34 also acts as a hinge for the side panels 22*a* and 22*d* to be folded upon each other, as explained below. The connections for the three other pairs of adjacent edges may be identical. Thus, the connections on the left side 26*a* and the right side 26*c* of each side panel 22*a*, 22*b*, 22*c* and 22*d* act as hinge connections for connecting an adjacent side panel.

At the top side 26*d* and the bottom side 26*b* of each side panel 22*a*, 22*b*, 22*c* and 22*d*, where there is no hinge connection to an adjacent side panel, the frame retaining sleeve 24*a*, 24*b*, 24*c* or 24*b* may be formed by merely folding over the corresponding fabric piece and applying a stitching 35 (see FIG. 1A). The fabric piece for the corresponding side panel may then be stitched to the sleeve.

Figure 2B:
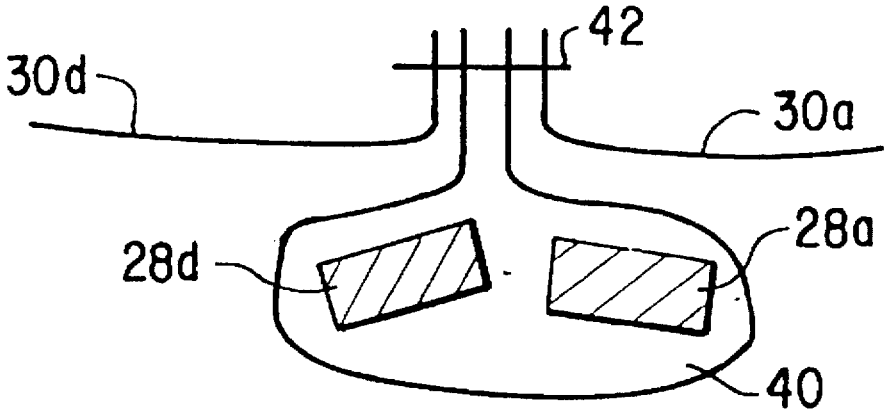
FIG. 2B is a cross-sectional view of a second preferred connection between two adjacent panels of the structure of FIG. 1 taken along line 2—2 thereof.

FIG. 2B illustrates a second preferred connection for connecting adjacent edges of two side panels 22*a* and 22*d*. As in the connection of FIG. 2A, the fabric pieces 30*a* and 30*d* are folded over at their edges at bottom side 26*b* and top side 26*d* to define the respective sleeves 24*a* and 24*d*. However, the frame retaining sleeves 24*a* and 24*d* converge at, or are connected to, one sleeve portion which interconnects side panels 22*a* and 22*d* to form a singular frame retaining sleeve 40 which retains the frame members 28*a* and 28*d*. Sleeve 40 may be formed by providing a tubular fabric, or by folding a piece of fabric, and applying a stitching 42 to its edges to connect the sleeve 40 to the fabric pieces 30*a* and 30*d*. Stitching 42 acts as a hinge for the side panels 22*a* and 22*d*. The connections for the three other pairs of adjacent edges may be identical.

An upper panel 32 comprised of fabric 30*e* may also be connected to the upper edge 26*d* of each side panel 22*a*, 22*b*, 22*c* and 22*d*. Likewise, a lower panel 36 comprised of fabric 30*f* may also be connected to the bottom edge 26*b* of each side panel 22*a*, 22*b*, 22*c* and 22*d*. The upper panel 32 and the lower panel 36 are preferably made of the same type of fabric as the side panels 22*a*, 22*b*, 22*c* and 22*d*. Each module 20 preferably comprises at least the four side panels 22*a*, 22*b*, 22*c* and 22*d*, with the upper and lower panels 32 and 36 being optional.

Openings 38 may be provided in some or all of the panels 22*a*, 22*b*, 22*c*, 22*d*, 32 and 36. These openings 38 may be of any shape (e.g., triangular, circular, rectangular, square, diamond, etc.) and size and are designed to allow an individual to crawl through them to enter or to exit the module 20. While the module 20 of FIG. 1 is shown and described as having four side panels, each having four sides, it will be appreciated that a module may be made of any number of side panels, each having any number of sides, without departing from the spirit and scope of the present invention. For example, each module may have three or more side panels, and each side panel may have three or more sides. Thus, the module of the present invention may take a variety of external shapes. However, each side panel of the module, regardless of its shape, is supported by at least one continuous frame member.

Figure 8A:
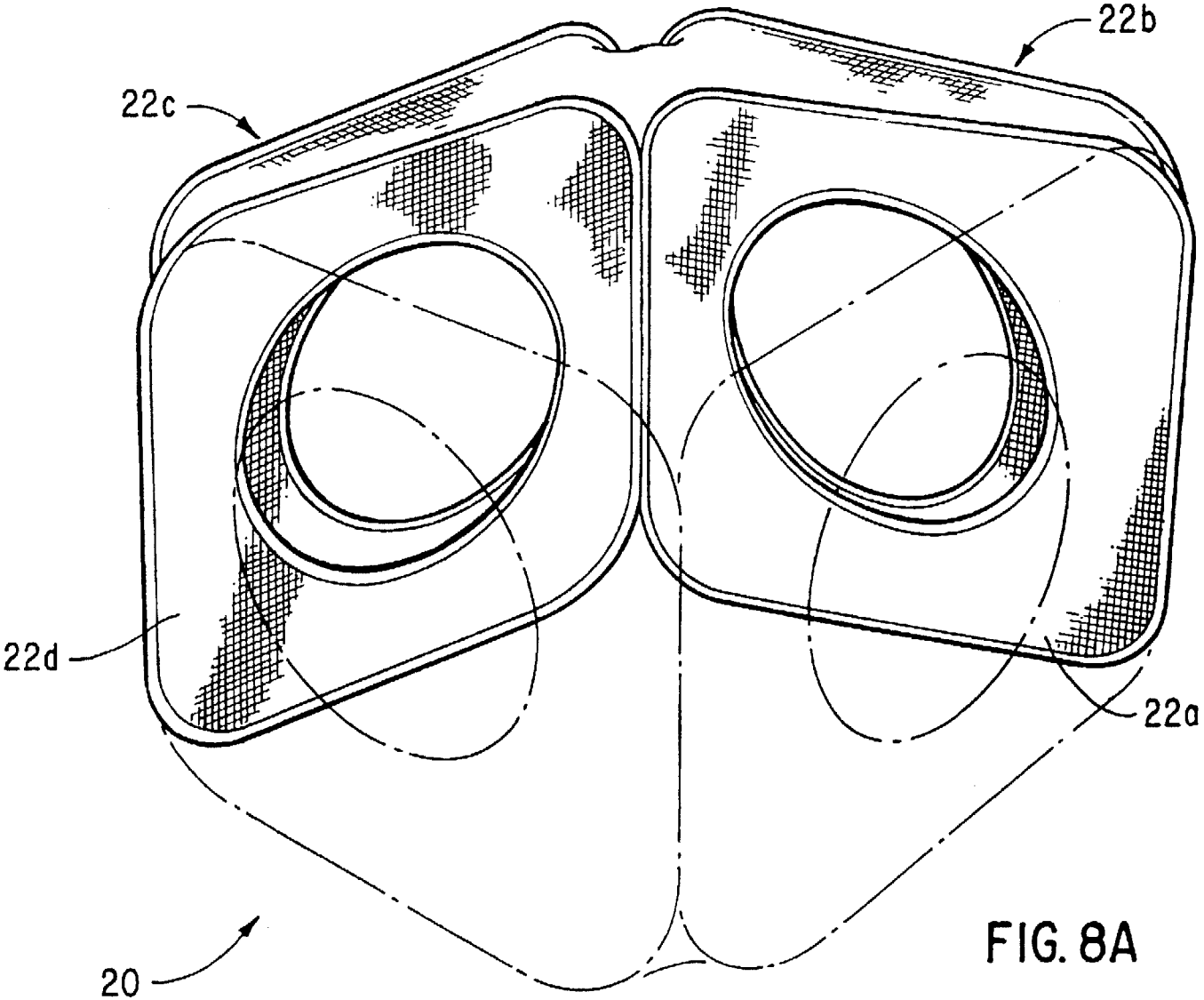
FIGS. 8(A) through 8(E) illustrate how the collapsible structure of FIG. 1 may be twisted and folded for compact storage.
Figure 8B:
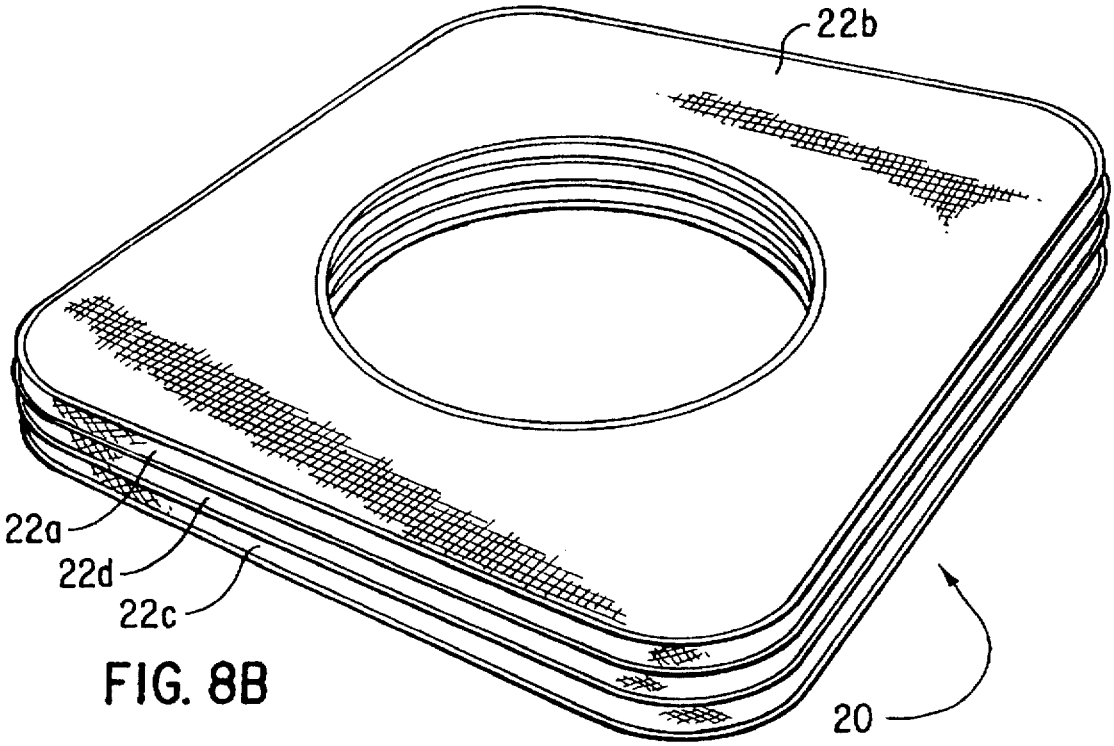
Figure 8C:
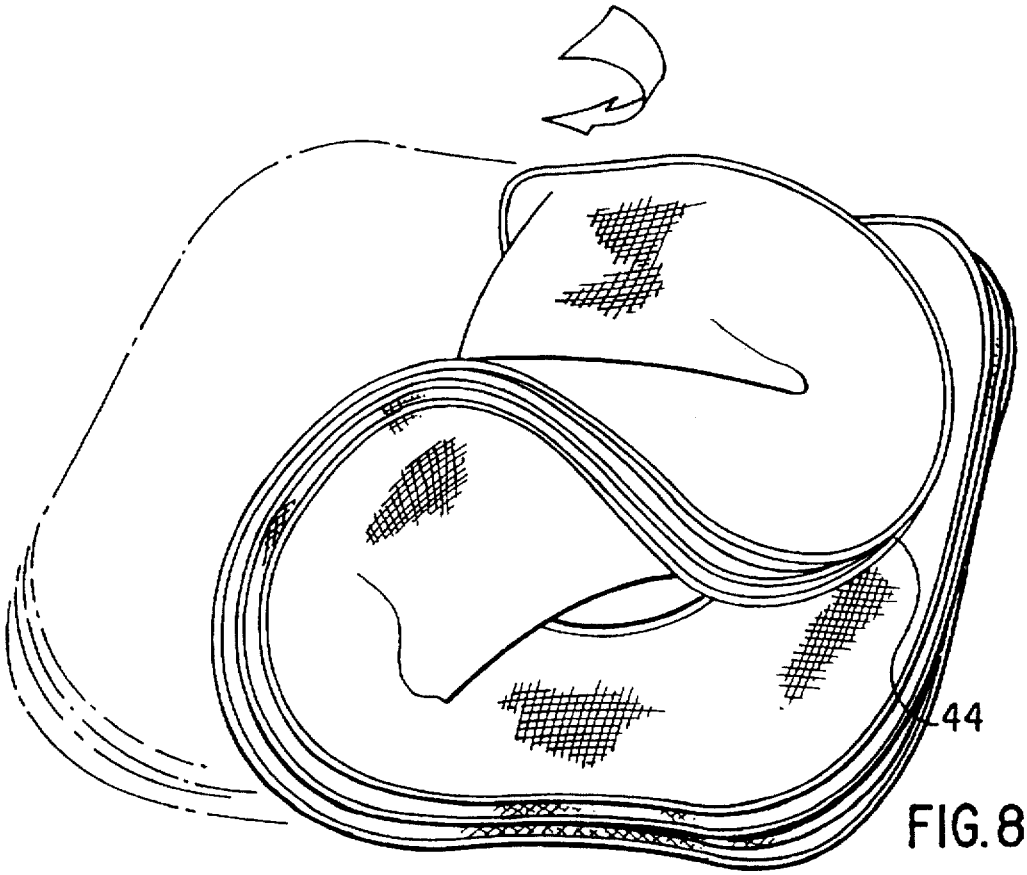
Figure 8D:
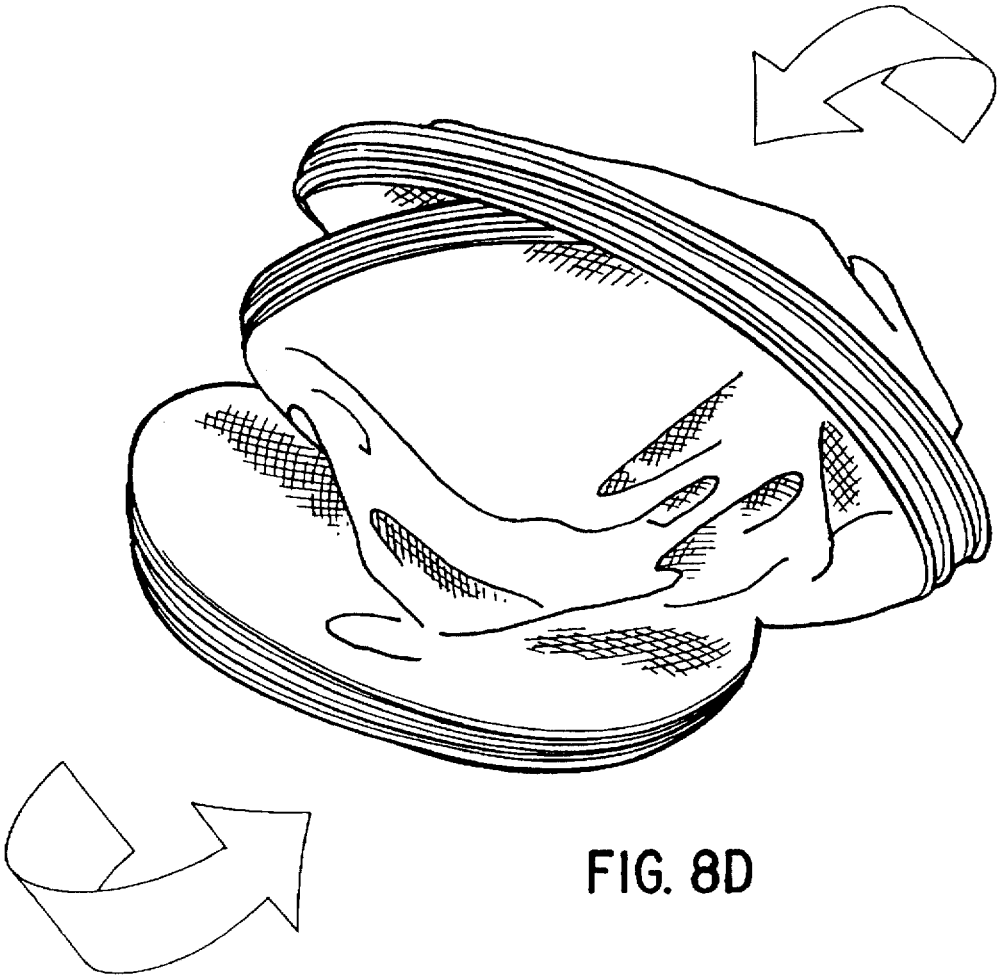
Figure 8E:
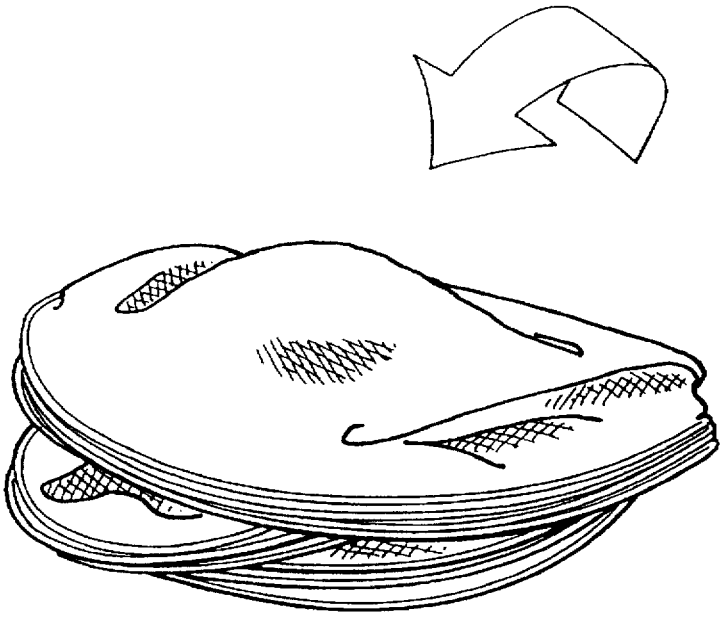

FIGS. 8(A) through 8(E) describe the various steps for folding and collapsing the structure or module 20 of FIG. 1 for storage. In FIG. 8(A), the first step consists of pushing in side panels 22*a* and 22*d* such that side panel 22*d* collapses upon side panel 22*c* and side panel 22*a* collapses upon side panel 22*b*. Then, in the second step shown in FIG. 8(B), the two side panels 22*a* and 22*b* are folded so as to be collapsed upon the two side panels 22*c* and 22*d*. The structure is then twisted and folded to collapse the frame members and side panels into a smaller shape. In the third step shown in FIG. 8(C), the opposite border 44 of the structure is folded in upon the previous fold to further collapse the frame members with the side panels. As shown in FIG. 8(D), the fourth step is to continue the collapsing so that the initial size of the structure is reduced. FIG. 8(E) shows the fifth step with the frame members and side panels collapsed on each other to provide for a small essentially compact configuration having a plurality of concentric frame members and layers of the side panels so that the collapsed structure has a size which is a fraction of the size of the initial structure.

Figure 3:
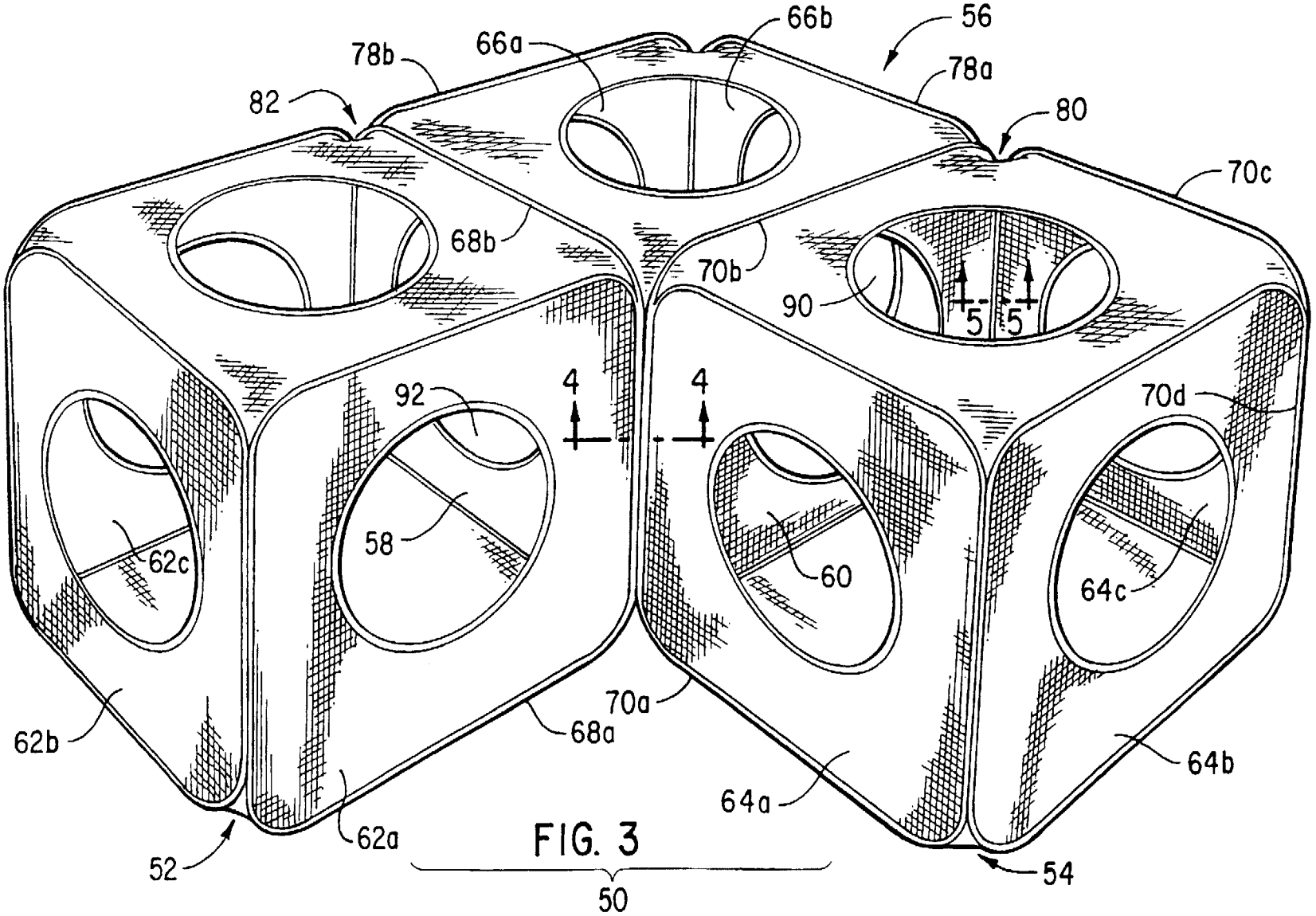
FIG. 3 is a perspective view of a collapsible structure according to a second preferred embodiment of the present invention comprising three modules.

A second preferred embodiment of the present invention is shown in FIG. 3. A structure 50 comprises three modules 52, 54 and 56 provided in an attached manner. Each module 52, 54 and 56 is essentially of the same construction as module 20, except that modules 52 and 56 share a common side panel 58, and modules 54 and 56 share a common side panel 60. The connections between adjacent side panels (i.e., the two side panel connections) may be the same as any of those illustrated in FIGS. 2A and 2B above.

Figure 4B:
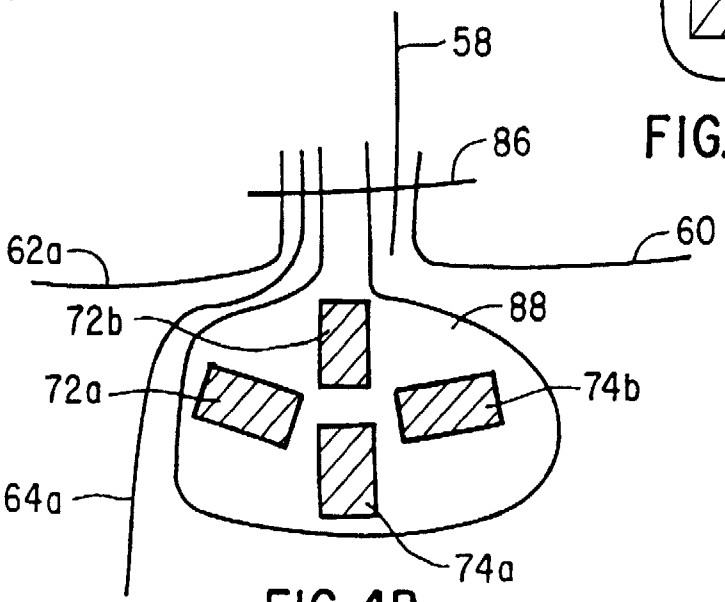
FIG. 4B is a cross-sectional view of a second preferred connection between the four adjacent panels of the structure of FIG. 3 taken along line 4—4 thereof.
Figure 4A:
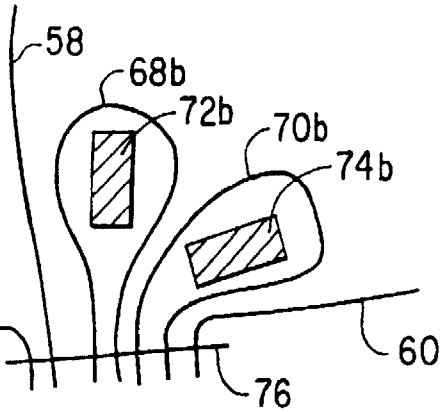
FIG. 4A is a cross-sectional view of a first preferred connection between the four adjacent panels of the structure of FIG. 3 taken along line 4—4 thereof.
Figure 4A:
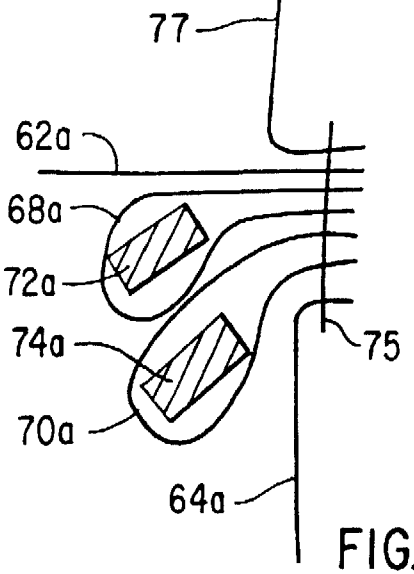

FIG. 4A illustrates a preferred four side panel connection along line 4—4 of FIG. 3, in which the four frame retaining sleeves 68*a*, 68*b*, 70*a* and 70*b* each retain a frame member 72*a*, 72*b*, 74*a* and 74*b*, respectively. Sleeves 68*a* and 70*a*, and side panels 62*a* and 64*a*, are connected by a stitching 75 and sleeves 68*b* and 70*b*, and side panels 58 and 60, are connected by a stitching 76. Each of the stitchings 75 and 76 also connect an interconnecting hinge fabric 77 which holds the two pairs of sleeves 68*a*, 70*a* and 68*b*, 70*b* together, and acts to hinge these two pairs of sleeves.

Alternatively, FIG. 4B illustrates a second preferred connection in which the four frame retaining sleeves 68*a*, 68*b*, 70*a* and 70*b*, each formed by a separate stitching, converge to form, or are connected to, one singular frame retaining sleeve 88 which retains the frame members 72*a*, 72*b*, 74*a* and 74*b*. The singular frame retaining sleeve 88 is created by folding a fabric material, or providing a tubular fabric, and applying a stitching 86 to connect the sleeve 88 to the side panels 58, 60, 62*a* and 64*a*. Stitching 86 acts as a hinge for the side panels 58, 60, 62*a* and 64*a*.

Figure 4C:
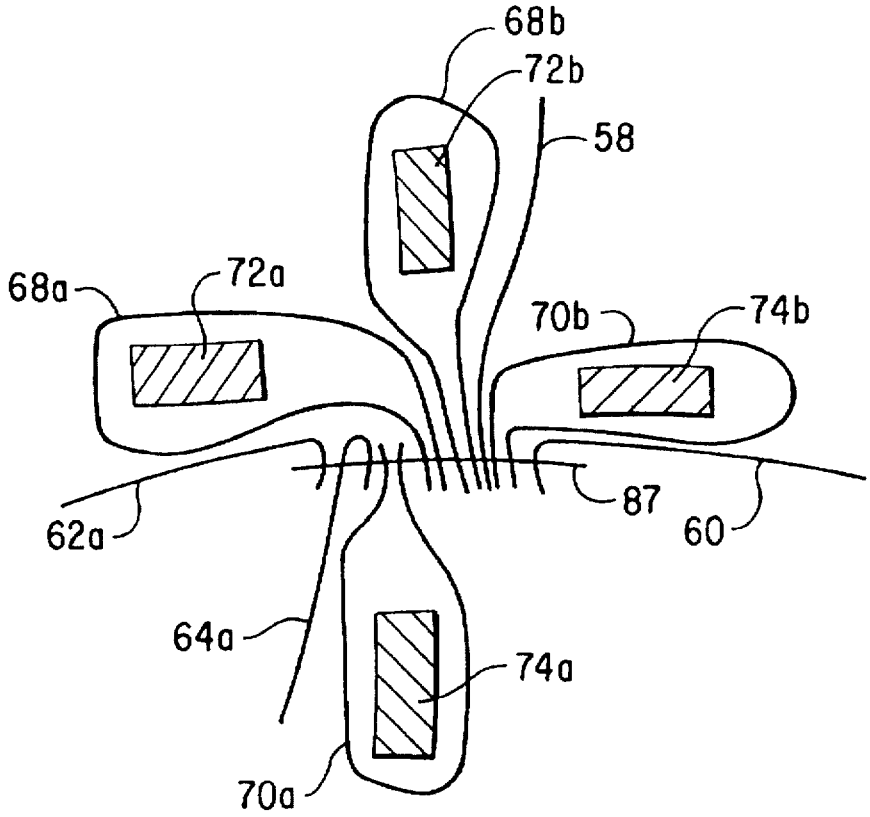
FIG. 4C is a cross-sectional view of a third preferred connection between the four adjacent panels of the structure of FIG. 3 taken along line 4—4 thereof.
Figure 4D:
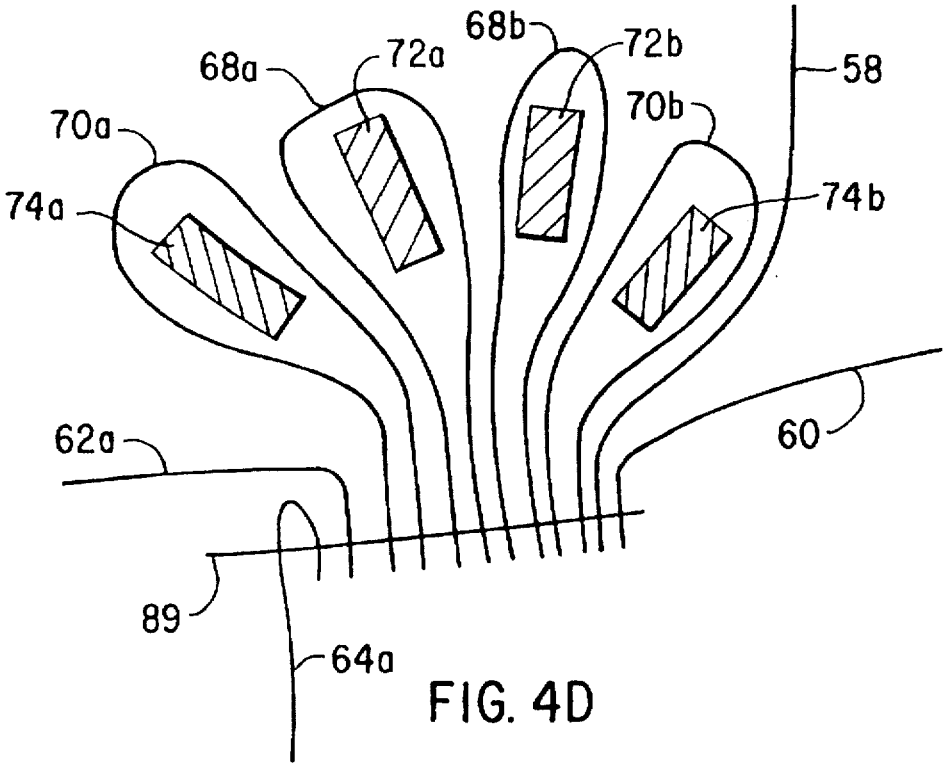
FIG. 4D is a cross-sectional view of a fourth preferred connection between the four adjacent panels of the structure of FIG. 3 taken along line 4—4 thereof.

FIGS. 4C and 4D illustrate third and fourth preferred connections in which the four frame retaining sleeves 68*a*, 68*b*, 70*a* and 70*b* each retain a frame member 72*a*, 72*b*, 74*a* and 74*b*, respectively, and are stitched together with the fabric pieces of the side panels 62*a*, 64*a*, 58 and 60 by stitching 87 (FIG. 4C) and stitching 89 (FIG. 4D). The stitchings 87 and 89 also act to hinge the side panels 58, 60, 62*a* and 64*a*.

Figure 5B:
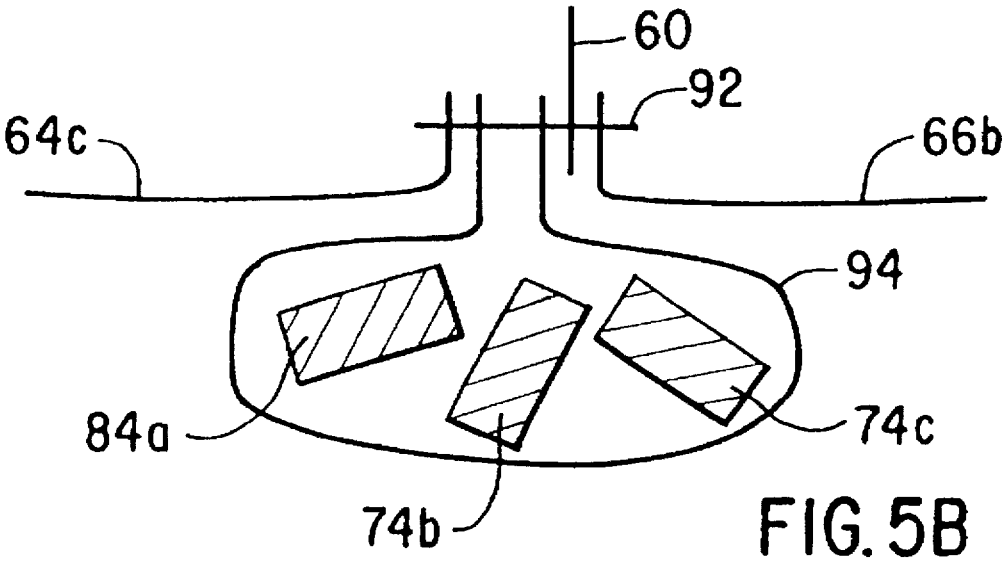
FIG. 5B is a cross-sectional view of a second preferred connection between the three adjacent panels of the structure of FIG. 3 taken along line 5—5 thereof.
Figure 5A:
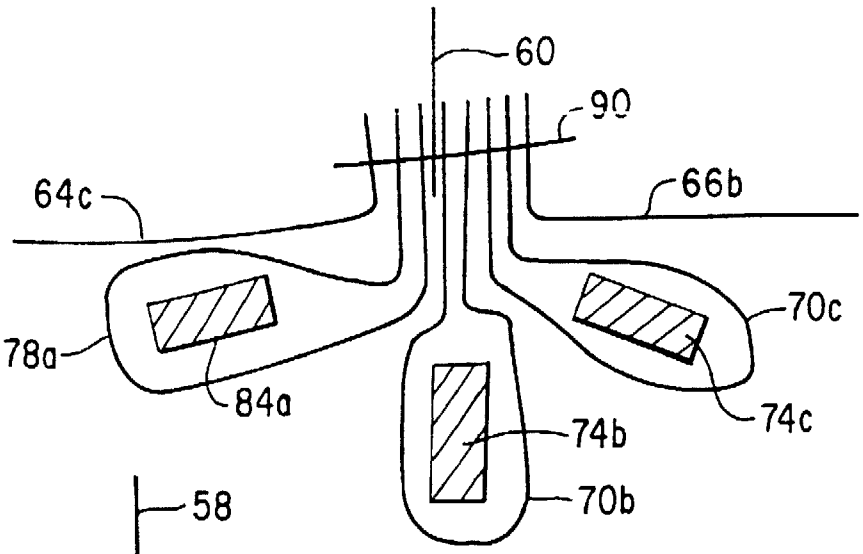
FIG. 5A is a cross-sectional view of a first preferred connection between the three adjacent panels of the structure of FIG. 3 taken along line 5—5 thereof.

FIG. 5A illustrates a preferred connection for the three side panel connection 80 along line 5—5 of FIG. 3, in which the three frame retaining sleeves 70*b*, 70*c* and 78*a* each retain a frame member 74*b*, 74*c* and 84*a*, respectively, and are held together by stitching 90. The fabric pieces of side panels 60, 64*c* and 66*b* are also stitched to the sleeves 70*b*, 70*c* and 78*a* by the stitching 90. Alternatively, FIG. 5B illustrates a second preferred connection in which the three frame retaining sleeves 70*b*, 70*c* and 78*a*, each formed by a separate stitching, converge to form, or are connected to, one singular frame retaining sleeve 94 which retains the frame members 74*b*, 74*c* and 84*a*. The singular frame retaining sleeve 94 is created by folding a fabric material and applying a stitching 92 to hold the sleeve 94 together with the side panels 60, 64*c* and 66*b*. The stitchings 90 and 92 act as hinges for the side panels 60, 64*c* and 66*b*. The three side panel connection 82 is identical to the three side panel connection 80 and is not further discussed herein.

To fold and collapse the structure 50, the side panels 62*a* and 62*b* of module 52 are pushed onto side panels 58 and 62*c*, respectively, the side panels 64*a* and 64*b* of module 54 are pushed onto side panels 60 and 64*c*, respectively, and the side panels 66*a* and 66*b* of module 56 are pushed onto side panels 58 and 60, respectively. Thereafter, combined side panels 62*b* and 62*c* are folded over to be collapsed upon the combined side panels 62*a* and 58, and combined side panels 64*b* and 64*c* are folded over to be collapsed upon the combined side panels 64*a* and 60. The combined side panels 66*b*, 60, 64*a*, 64*b* and 64*c* are then folded over and collapsed upon the combined side panels 66*a*, 58, 62*a*, 62*b* and 62*c*, thereby creating a stack of ten side panels. The combined stack of ten side panels may then be twisted and folded in the manner described above in connection with FIGS. 8 (C)–8 (E).

Alternatively, the three modules 52, 54 and 56 of structure 50 may be provided as three separate modules, each having four side panels. Each such module could be identical to module 20 of FIG. 1. The three separate modules may be connected by conventional attachment methods such as velcro, hooks, loops, fasteners or others, to create the structure 50, or another structure with a different shape. For example, an individual may choose to create a structure having three modules 52, 54 and 56 arranged in a linear manner. The attachment method allows for convenient attachment and detachment. Each module may be folded and collapsed in the manner described in FIGS. 8(A)–8(E).

Regardless of whether the modules 52, 54 and 56 are provided separately or as an attached structure, the entire structure 50 may be conveniently folded and collapsed, thereby making it convenient to move around, and requiring little storage space. If the modules 52, 54 and 56 are provided separately, the individual further derives an additional variety of play since he or she can create play structures of different shapes. Additionally, an individual may derive amusement by attempting to align the openings 90 and 92 in the interfacing side panels so that he or she can crawl from one module into another.

Although the structure 50 is shown as having three modules 52, 54 and 56, each being of the same size and shape, it will be appreciated that the present invention encompasses within its scope structures having any number of modules, each having any number of different sizes and shapes and being made from side panels having any number of different sizes and shapes.

Figure 6:
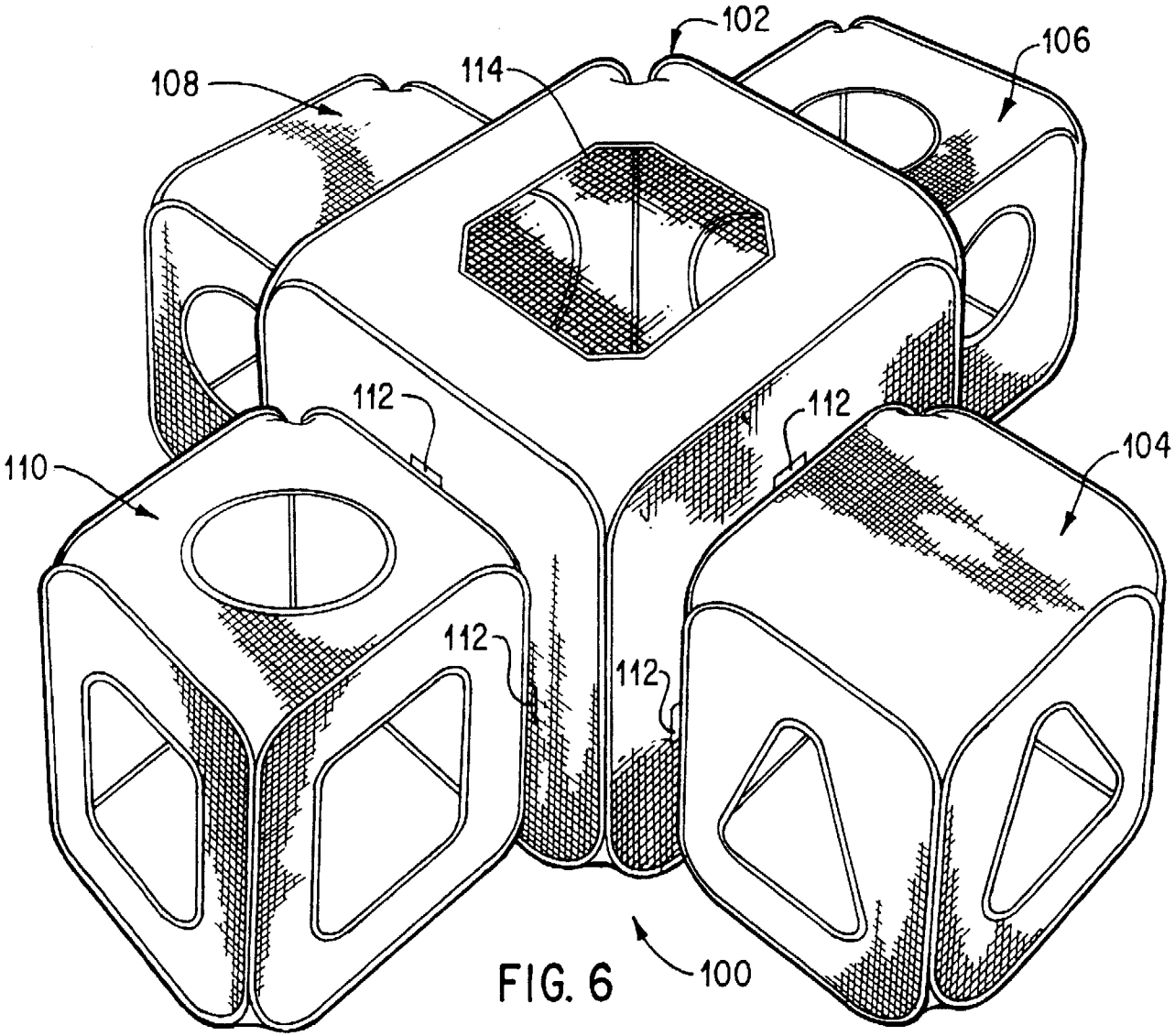
FIG. 6 is a perspective view of a collapsible structure according to a third preferred embodiment of the present invention comprising four modules connected to the different side panels of one large module.

An example is illustrated in the third preferred embodiment of FIG. 6. The structure 100 comprises a large module 102, and four identical but smaller modules 104, 106, 108 and 110, each connected to one of the four side panels of the large module 102 by a conventional attachment method, for example, velcro 112. A mesh 114 may be provided to cover an opening in the large module 102. The openings in the modules 102, 104, 106, 108 and 110 may be provided in varying shapes and sizes. Although the structure 100 is shown as having four identical modules 104, 106, 108 and 110, these four modules may be provided in different shapes and sizes.

The separate modules according to the present invention may be provided or purchased on an individual basis, in different shapes and sizes, so that an individual may be able to create a structure of a desired shape and size. Alternatively, a specific number of differently shaped and sized modules may be packaged and sold together. In either case, the individual will have the opportunity to create an endless variety of structures at his or her disposal, thereby enhancing the amusement value of the modules, and stimulating creativity by challenging the individual to create as many different structures as possible.

Figure 7:
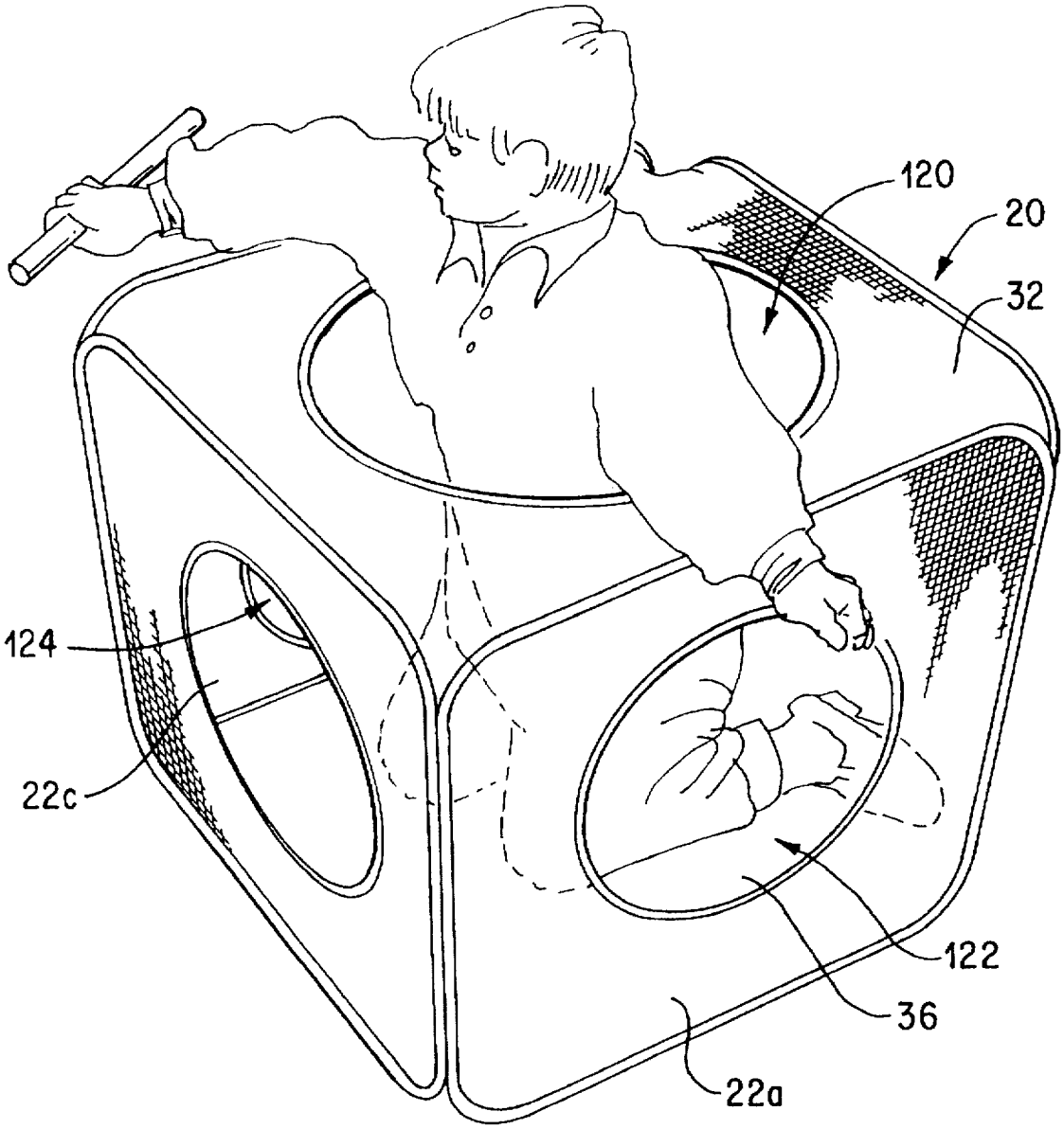
FIG. 7 is a perspective view of the collapsible structure of FIG. 1 which may be sized to allow a child to wear the structure as part of a costume.

FIG. 7 illustrates an additional application for the module 20. The module 20 may be sized such that it may be fitted around the body of a child, to act as part of a costume. The module 20 may then be able to support other bulky costumes, and would be especially useful for occasions such as halloween. For example, the child's head and arms could extend through opening 120 in the upper panel 32 and his legs could extend through an opening (not shown) in the lower panel 36. Alternatively, the module 20 could be sized small enough so that the child's arms could extend through the openings 122 and 124 in the side panels **22*a* and 22*c*, respectively. Further, the lower panel 36** could be omitted if desired.

Referring now to FIGS. 9–17, each module or collapsible structure of the present invention can be further modified for use as collapsible arcade game structures.

Figure 9:
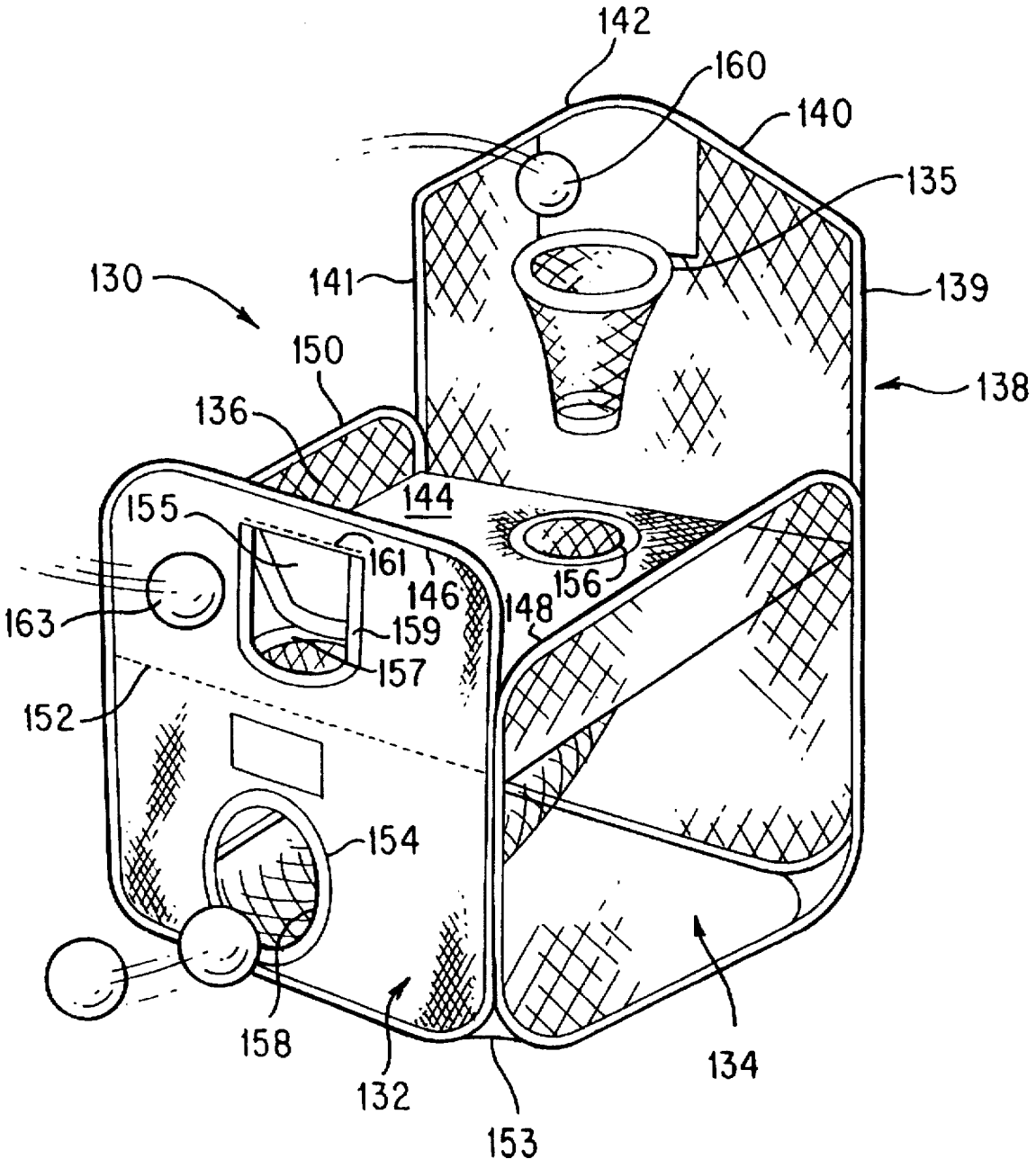
FIG. 9 is a perspective view of a collapsible structure according to a fourth preferred embodiment of the present invention where the structure takes the form of a basketball arcade game.

FIG. 9 illustrates a collapsible arcade game structure 130. The structure 130 is similar to structure 20, and has four panels 132, 134, 136 and 138. Panels 132, 134, 136 and 138 have essentially the same structure and construction, and are hingedly connected to each other in the same manner, as the side panels **22*a*, 22*b*, 22*c* and 22*d* of structure 20. However, rear panel 138 is vertically higher than the other panels 132, 134 and 136, and has a basket 135 sewn or otherwise attached adjacent its upper edges 140 and 142 on the side of the panel 138 facing the interior of the structure 130. The panel 138 can have four side edges, or as shown in FIG. 9, can actually have two top edges 140 and 142 each having a lower end connected to the two side edges 139 and 141 and an upper end connected at an angle to each other, to form an arched configuration. In addition, the side panels 134 and 136 are configured so that their top edges 148 and 150 are slanted or disposed at an angle with respect to the horizontal axis, so that the top edges 148 and 150 are at a higher vertical level adjacent rear panel 138 than adjacent front panel 132**.

A top fabric 144 is stitched or otherwise attached to the panels 132, 134 and 136 at locations offset from their upper edges 146, 148 and 150, respectively, and is stitched or otherwise attached to the rear panel 138 at about a central portion thereof. For example, stitch line 152 illustrates the location where top fabric 144 is attached to panel 132. Although the top fabric 144 is illustrated in FIG. 9 as being attached to the side panels 134 and 136 in a manner offset from their upper edges 148 and 150, respectively, it is possible to attach the top fabric 144 to any vertical level of the panels 132, 134, 136 and 138, including along the upper edges 148 and 150. For example, as shown in FIG. 9, the top fabric 144 can be provided in a slanted manner, or at an angle, such that it is attached at a higher vertical level at the rear panel 138 than at the front panel 132. This will cause all balls 160 landing on the top fabric 144 to roll from the rear panel 138 towards the front panel 132.

The front panel 132 defines an upper opening 159 positioned above the stitch line 152 of the top fabric 144. A flap 155 is hingedly connected along an upper edge, such as by stitching 161, to an upper edge of the opening 159 to cover the opening 159. Alternatively, the flap 155 can be provided by cutting its three edges from the fabric of the front panel 132, while leaving the upper edge attached to the fabric to act as a hinge for the flap 155. A lower opening 154 is also provided in front panel 132, and openings 156 and 157 are provided in the top fabric 144. Opening 156 is positioned adjacent rear panel 138 and under the basket 135 to receive balls 160 falling through the basket 135, while opening 157 is positioned adjacent front panel 132 to receive balls 163 tossed through the flap 155 of opening 159. Each opening 154, 156, 157 and 159 is optionally provided with a border which accentuates the opening and provides the structure 130 with an aesthetically attractive appearance.

A tube or a substantially U-shaped collection netting 158 has its opposing ends stitched or otherwise connected to the openings 154 and 156. Alternatively, the ends of the tube or netting 158 may be removably attached to the openings 154 and 156 by a removable connection mechanism, such as but not limited to opposing Velcro pads, hooks, ties or similar mechanisms. Both the tube 158 and the netting 158 can be made from a non-transparent fabric material, or from a mesh or transparent material that allows the interior of the tube or netting 158 to be viewed. The material is preferably a flexible material which allows the tube 158 and netting 158 to be folded and collapsed along with the panels of the structure 130. The opening 157 opens into the tube or the netting 158, so that balls 163 tossed through the flap 155 of opening 159 will pass through opening 157 into the tube or netting 158 and be returned to the player via opening 154.

An optional bottom fabric 153 may be stitched or otherwise attached to the panels 132, 134, 136 and 138 along their bottom edges thereof.

The structure 130 is adapted for use as a miniature basketball arcade game. A ball 160 may be tossed towards the top opening of the basket 135, and if the ball 160 falls through the basket 135, it will be directed to pass through opening 156 in top fabric 144, through the tube or netting 158 and out of the structure 130 through opening 154 to be returned to the player. The sizes of the openings 154, 156, 157 and 159, and of the top opening of the basket 135, as well as the size of the ball 160, can be adjusted to change the degree of difficulty. In addition, although the openings 154, 156 and 157 are illustrated as being substantially circular, they can also be provided in any desired shape. If the ball 160 misses the basket 135 but falls within the confines of the four panels 132, 134, 136 and 138, it will land on the top fabric 144, and depending on where it lands, the ball 160 could still fall through opening 156 or 157 to be returned to the player. Since the opening 156 is to be aligned with the bottom of the basket 135 to receive the ball 160, the location of the opening 156 on the top fabric 144 is therefore dependent on the height or vertical level of the top fabric 144. Another method of play involves tossing a ball 163 pass the flap 155 of opening 159 and through opening 157 to cause the ball 163 to be returned to the player via the tube or netting 158 and the opening 154.

The side panels 134 and 136 preferably have the same longitudinal length. Rear panel 138 acts as a backboard for the ball 160. Although FIG. 9 illustrates front panel 132 as having a fabric panel and the panels 134, 136 and 138 as having meshed panels, any or all of the panels can be provided in a fabric material, a meshed material, or a combination of materials. The meshed material is preferred where it is desired to allow the player to view the interior of the structure 130.

The structure 130 may be folded and collapsed in the same manner as the structure 20. Specifically, panels 132 and 134 are pushed against panels 136 and 138, respectively. The combined panels 132, 136 are then pushed against the combined panels 134, 138 to create a stack of four panels, which are then folded and collapsed in the manner shown in 8C–8E.

Figure 10:
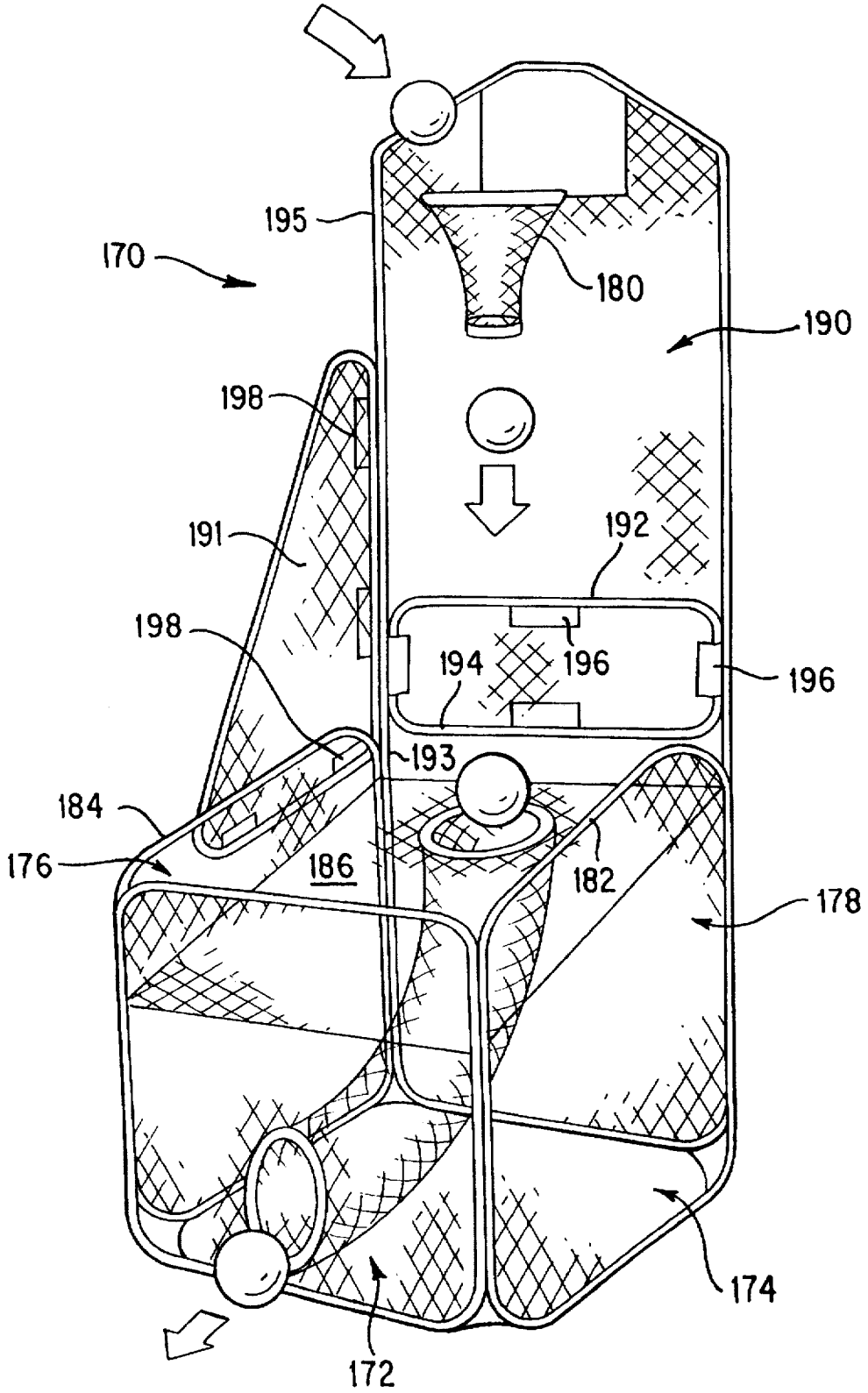
FIG. 10 is a perspective view of a collapsible structure according to a fifth preferred embodiment of the present invention where the structure takes the form of a basketball arcade game.

FIG. 10 illustrates a modification to the structure 130, in which the rear panel 178 of the structure 170 does not have a basket attached thereto. Instead, another panel 190 is removably attached to the upper end of rear panel 178. The panel 190 has a basket 180 attached to the side facing the interior of the structure 170. The additional panel 190 therefore positions the basket 180 at a higher vertical level to more closely simulate a real basketball situation. The panels 178 and 190 are attached by first overlapping the upper end of panel 178 and the lower end of panel 190 so that the top edge 192 of panel 178 is at a higher vertical level than the bottom edge 194 of panel 190, and then connecting a removable attachment mechanism 196 provided on the panels 178 and 190. The removable attachment mechanism 196 can include but is not limited to hooks, ties, opposing Velcro pads and other similar conventional attachment mechanisms.

To provide support for the panels 178 and 190, a support panel 191 may be removably attached to the left side edges 193 and 195 of panels 178, 190, respectively, and the top edge 184 of side panel 176. This removable attachment can again be accomplished by use of opposing Velcro pads 198, hooks, ties and other similar conventional attachment mechanisms. The support panel 191 has the same structure as the other panels of the present invention, except that its shape is different. In this embodiment, support panel 191 has a substantially triangular shape, although any shape can be used. Although only one support panel 191 is illustrated, it is also possible to provide an additional support panel for supporting the right side of panels 178, 190. The top fabric 186 of the structure 170 may likewise be slanted from the rear to the front of the structure 170.

To fold and collapse the structure 170, the support panel 191 is removed from the structure 170, and the panel 190 is then removed from the rear panel 178. The panels 172, 174, 176 and 178 of the structure 170 are then folded and collapsed in the manner described above for structure 130. The panel 190 is preferably laid against the rear panel 178 and the resulting stack of five combined panels folded and collapsed in the manner shown in 8C–8E. The support panel 191 can be folded and collapsed on its own according to the method shown in FIGS. 8C–8E, or it can also be folded and collapsed together with the other panels of structure 170.

Figure 11:
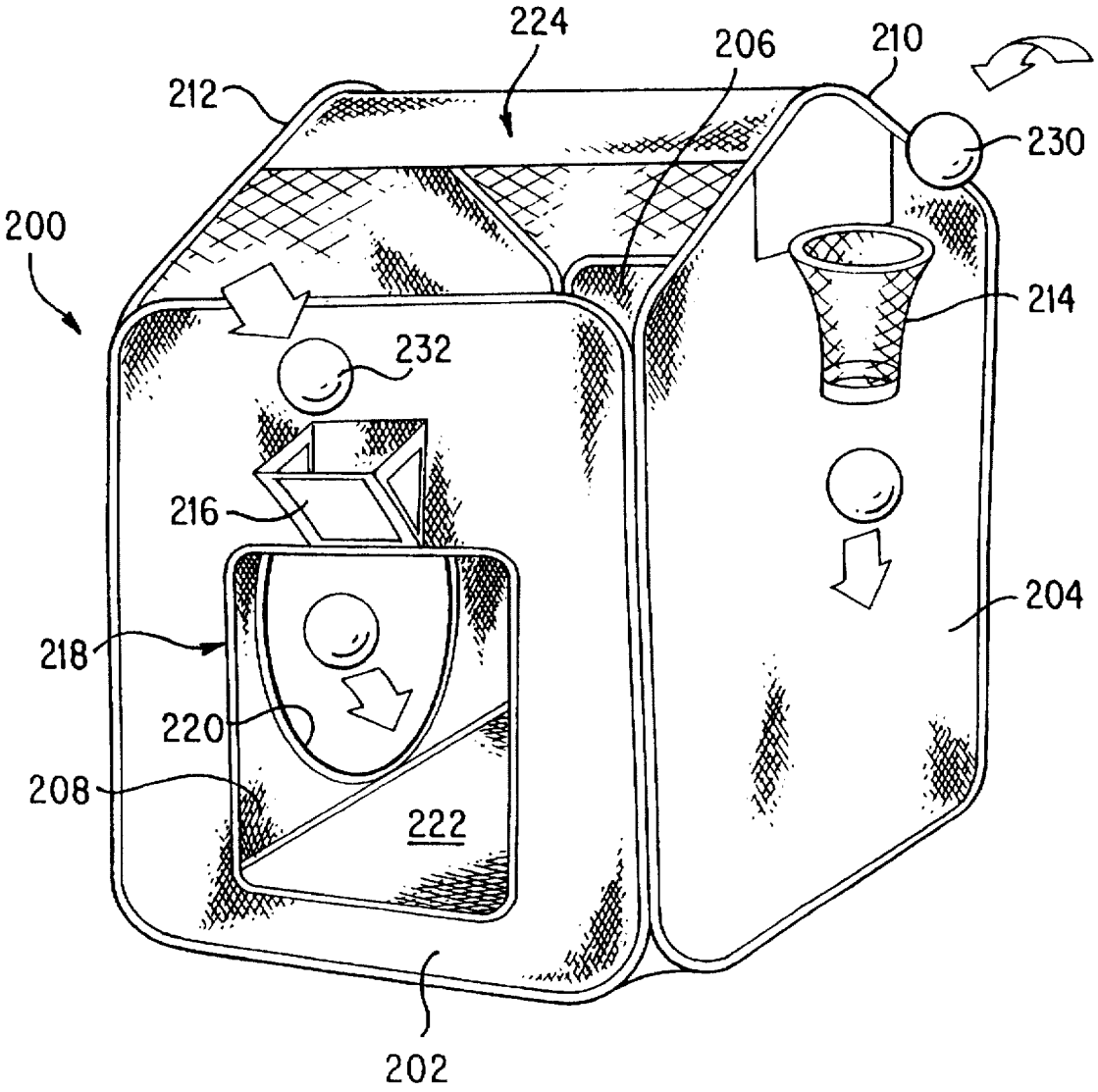
FIG. 11 is a perspective view of a collapsible structure according to a sixth preferred embodiment of the present invention where the structure provides multiple arcade games.

FIG. 11 illustrates a structure 200 that provides multiple arcade games. Structure 200 is essentially the same as structure 20, and has four side panels 202, 204, 206 and 208. Side panels 202, 204, 206 and 208 have essentially the same structure and construction, and are hingedly connected to each other in the same manner, as the side panels 22*a*, 22*b*, 22*c* and 22*d* of structure 20, except that the shape of side panels 204 and 208 is different. In this regard, the top edge 210 and 212 of side panels 204 and 208, respectively, is either arched or divided into two separate top edges similar to the top edges 140, 142 for structure 130. Side panels 204 and 208 also extend vertically higher than side panels 202 and 206 to create an overall arched configuration for the structure 200.

A basket 214 is sewn or otherwise attached adjacent the upper edge 210 of side panel 204 on the side of the side panel 204 facing the exterior of the structure 200. A collection trough 216 is provided at the side panel 202 which opens into the interior of the structure 200. Openings 218 and 220 may be provided in side panels 202 and 208, respectively, to provide ingress and egress to the interior of the structure 200. A fabric base 222 may be sewn or otherwise attached to the bottom edges of the side panels 202, 204, 206 and 208. A top fabric 224 may be sewn or otherwise attached to the top edges of the four side panels 202, 204, 206 and 208, and may take an arched configuration similar to the arched configuration defined by the top edges of these four side panels 202, 204, 206 and 208.

The structure 200 provides a number of different games. For example, a ball 230 may be tossed at the basket 214, and another ball 232 may be tossed at the trough 216. Any ball 232 passing through the trough 216 will be deposited inside the structure 200, so the player will need to reach inside the structure through opening 218 or 220 to retrieve the ball 232. On the other hand, any ball 230 tossed at the basket 214 will stay outside the structure 200, regardless of whether the ball 230 passes through the basket 214. In addition, baskets, troughs or other features can be provided on the other side panels 206 and 208. Having two or more amusement features or games, such as baskets and collection troughs, associated with one structure significantly enhances the variety and entertainment for both children and adults alike.

Structure 200 may be folded and collapsed in the same manner as structure 130. Specifically, two side panels are pushed onto the other two side panels, and each combined pair of side panels are then pushed onto each other to form a stack of four side panels, which are folded and collapsed in the manner shown in 8C–8E.

Figure 12:
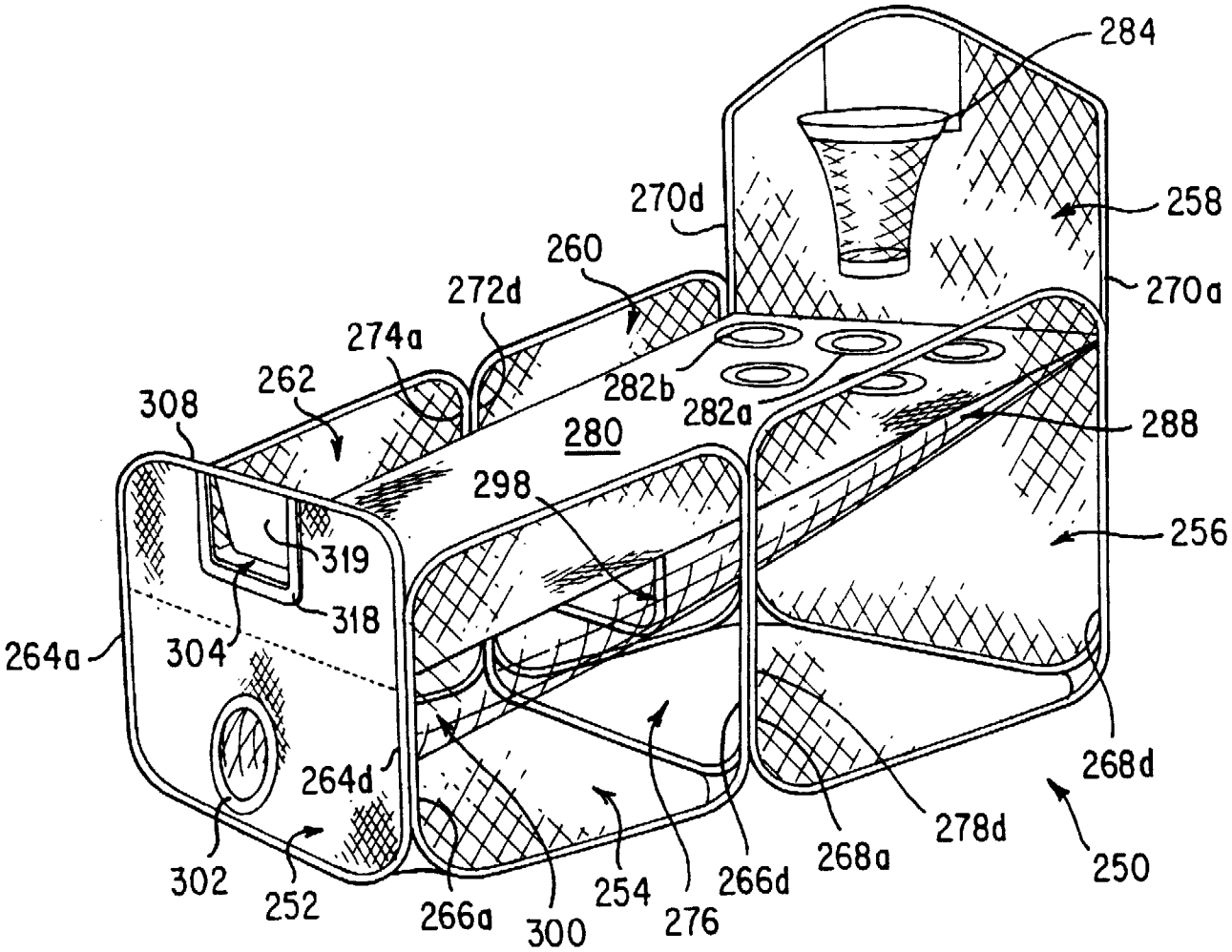
FIG. 12 is a perspective view of a collapsible structure according to a seventh preferred embodiment of the present invention where the structure takes the form of a basketball arcade game.

FIG. 12 illustrates yet another arcade game structure 250 according to the present invention. Structure 250 has six panels 252, 254, 256, 258, 260 and 262 that have essentially the same structure and construction, and are hingedly connected to each other in the same manner, as the side panels 22*a*, 22*b*, 22*c* and 22*d* of structure 20, except that the shape of each panel 252, 254, 256, 258, 260 and 262 is different. Front panel 252 forms the front end of the arcade game structure 250, while rear panel 258 forms the back end of structure 250. Side panels 254 and 256 form a side wall for the structure 250, while side panels 260 and 262 form another side wall. Panel 252 has a right side **264*d* hingedly connected to a left side 266*a* of panel 254. A right side 266*d* of panel 254 is hingedly connected to a left side 268*a* of panel 256. A right side 268*d* of panel 256 is hingedly connected to a left side 270*a* of panel 258. A right side 270*d* of panel 258 is hingedly connected to a left side of panel 260. A right side 272*d* of panel 260 is hingedly connected to a left side 274*a* of panel 262. A right side of panel 262 is hingedly connected to a left side 264*a* of panel 252**.

To provide further structural support for the structure 250, a panel 276 having a structure and construction that is similar to any of the panels of the present invention may be connected to the connections of the sides **266*d*, 268*a* and 272*d*, 274*a*. Specifically, the panel 276 is positioned between side panels 254 and 256, and between side panels 260 and 262, such that one side 278*d* of panel 276 is connected to sides 266*d* and 268*a* of side panels 254 and 256, respectively, and another side is connected to sides 272*d* and 274*a* of side panels 260 and 262, respectively. The three-sided connections of sides 266*d*, 268*a*, 278*d* and 272*d*, 274*a* and the other side of panel 276, may be accomplished by either of the methods illustrated in FIGS. 5A and 5B**.

A top fabric 280 extends across the top of the structure 250 and is connected to all the panels 252, 254, 256, 258, 260 and 262 along varying heights, but preferably covering the top of panel 276. Top fabric 280 may be slanted from the rear of the structure 250 to the front to cause balls to roll towards the front panel 252. A plurality of openings 282 are provided in spaced-apart manner on top fabric 280 in the vicinity of the basket 284, which is attached to the interior side of rear panel 258. One opening **282*a* is preferably aligned with the net of the basket 284 to receive a ball that has passed through the basket 284. The plurality of openings 282 is provided so that a player can achieve a different score depending on the opening through which the ball 286 enters. For example, the highest score is achieved for tossing the ball 286 through the basket 284 and the aligned opening 282*a*, while a lesser score is achieved for tossing the ball 286 through a side opening 282*b***. The other openings can each represent different points or scores.

A funnel guide 288 is provided inside the structure 250 for guiding balls from the openings 282 back out to the player. The funnel guide 288 is illustrated in greater detail in FIG. 12B, and has a ramp 290 that slopes and narrows from the rear to the front. The rear edge 291 of the ramp 290 is attached to the panel 258 adjacent the top fabric 280. Side walls **286*a* and 286*b* are provided on the sides of the ramp 290 to guide the balls towards a narrowed end 296 of the funnel 288. The narrowed end 296 of the funnel 288 is connected to a window or opening 298 in panel 276. Opposing ends of a tubular guide 300 are connected to the window 298 and another opening 302 in panel 252. Thus, all balls 286 passing through any of the openings 282 will roll down the ramp 290, pass through the window 298, roll through the tubular guide 300 and out through the opening 302 in the front panel 252. As a result, it is preferable that the vertical level of the openings 282 be higher than the vertical level of the window 298, and that the vertical level of the window 298 be higher than the vertical level of the opening 302**.

Figure 12A:
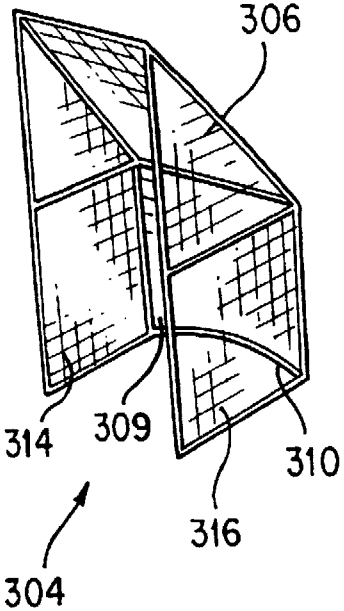
FIGS. 12A and 12B illustrate components of the structure of FIG. 12.
Figure 12B:
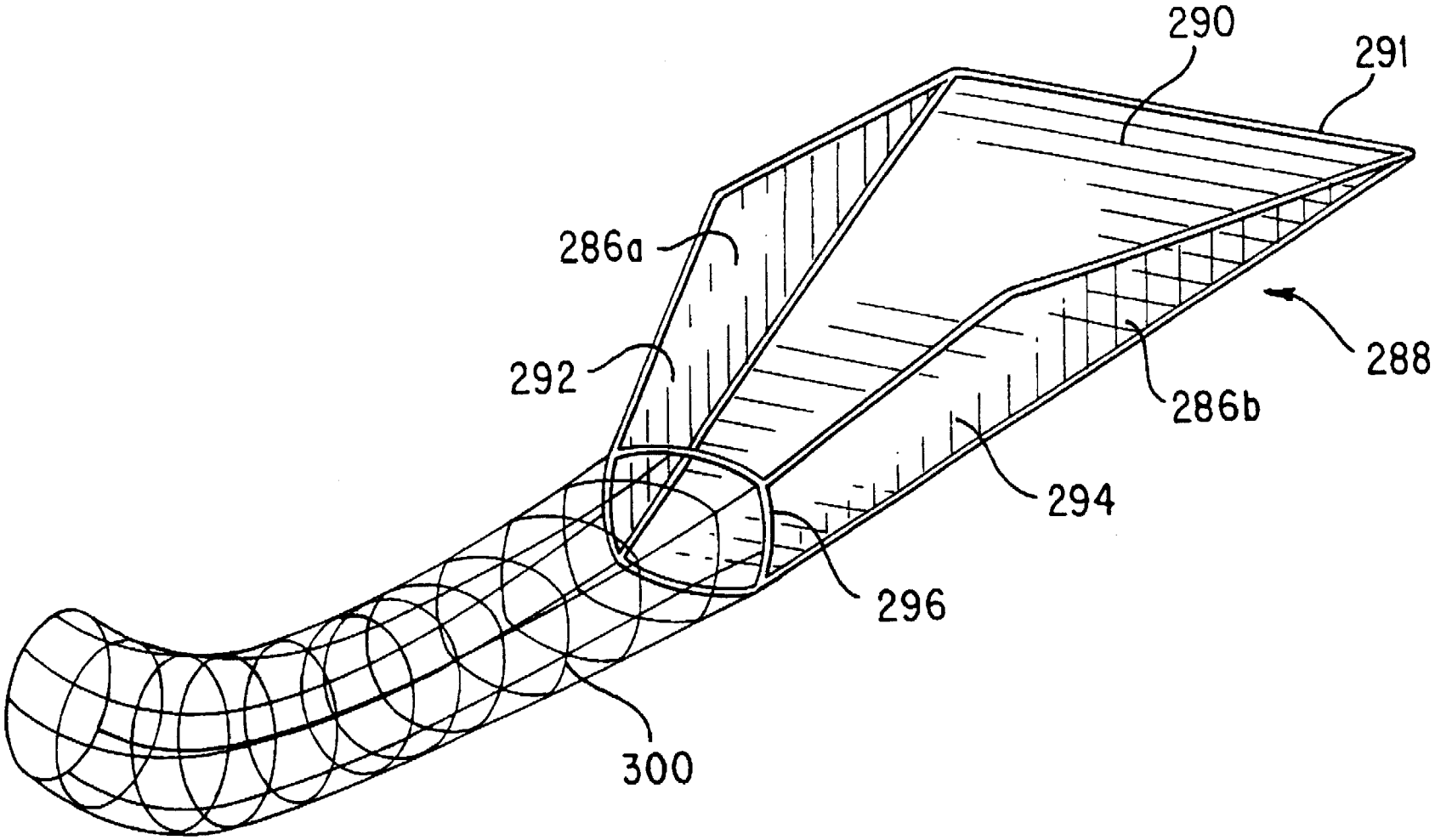

At the front of the structure 250 is provided a cage 304 which is illustrated in greater detail in FIG. 12A. The cage 304 is preferably made from a fabric or mesh-like material, and has a sloped rear wall 306 attached at its upper end to the top edge 308 of front panel 252, and attached at its lower end to a vertical rear wall 309 which has a lower end 310 connected to a top opening (not shown) of the tubular guide 300. As shown in FIG. 12A, lower end 310 has a curved arch configuration which tracks the curvature of the tubular guide 300. The cage 304 further includes side walls 314 and 316 which are attached to the surface of the panel 252 that faces the interior of the structure 250. The three enclosing walls 309, 314 and 316 of the cage 304 are fitted through a front opening (not shown) in the top fabric 280 so that the cage 304 is in communication with the tubular guide 300. An upper opening 318 and a flap 319, similar to opening 159 and flap 155 of structure 130, are provided in the panel 252 adjacent the top edge 308 and aligned with the cage 304, so that balls passing through the upper opening 318 will be guided by the cage 304 into the tubular guide 300 and returned to the player through the opening 302.

The funnel 288 and the cage 304 are preferably made from fabric, mesh, PVC sheet, or any other flexible material which can be folded and collapsed together with the rest of the structure 250. The tubular guide 300 is similar to the tube or netting 158 in structure 130, and can be made from the same materials as the tube or netting 158.

The structure 250 may be folded and collapsed in the following manner. Panels 252 and 254 are pushed onto panels 262 and 276, respectively. The combined panels 252, 262 are then pushed against the combined panels 254, 276 to create a stack of four panels. This stack of four panels and panel 256 are then pushed onto panels 260 and 258, respectively. The combined panels 256, 258 are then pushed against the other five combined panels 252, 254, 260, 262 and 276 to create a stack of seven panels, which are then folded and collapsed in the manner shown in 8C–8E.

Figure 13:
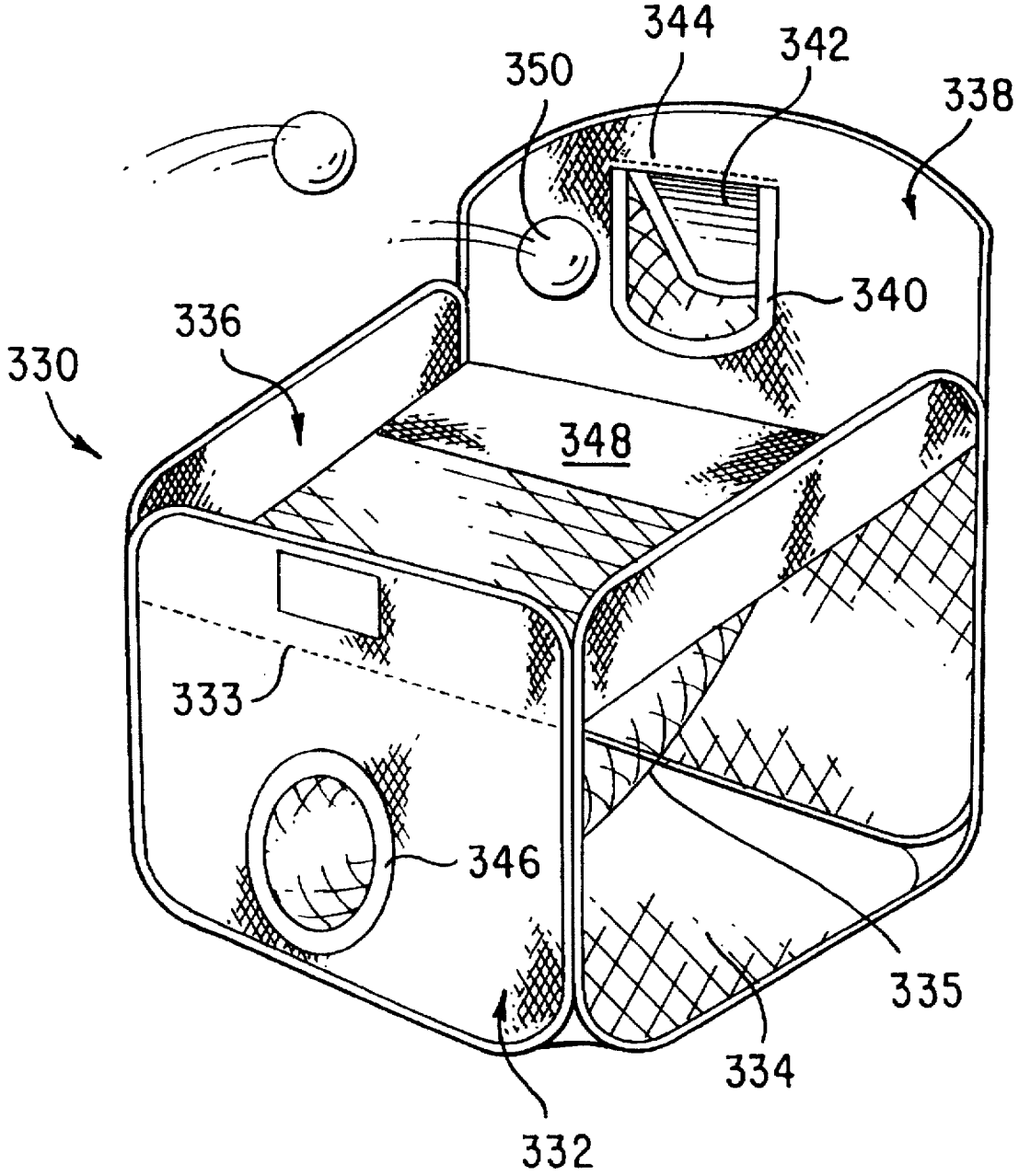
FIG. 13 is a perspective view of a collapsible structure according to an eighth preferred embodiment of the present invention.
Figure 14:
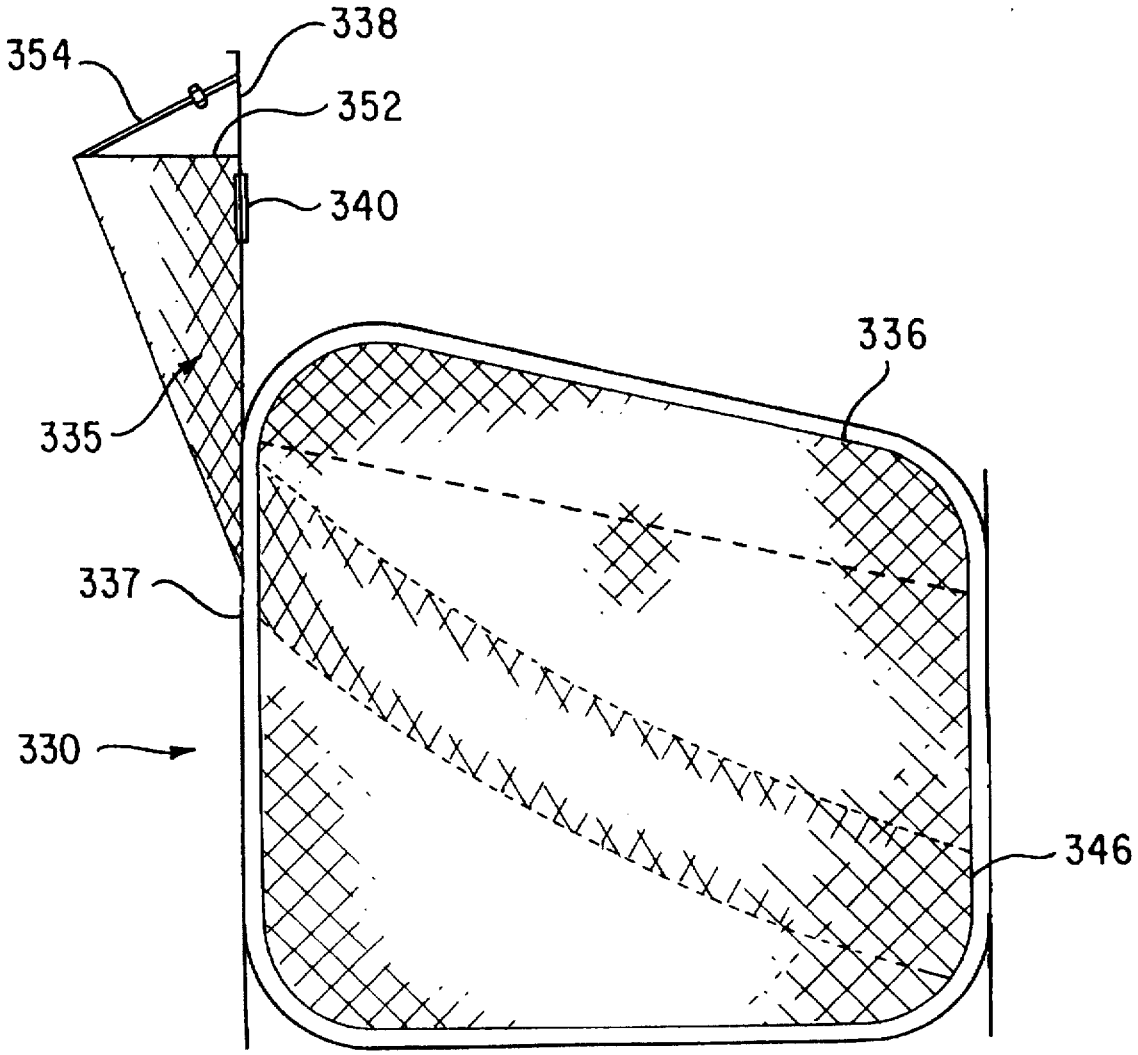
FIG. 14 is a side plan view of the structure of FIG. 13.

FIGS. 13 and 14 illustrate yet another arcade game structure 330 according to the present invention. Structure 330 has four panels 332, 334, 336 and 338 that are essentially the same as panels 132, 134, 136 and 138, respectively, of structure 130, except for a few modifications. First, instead of a basket provided at the rear panel 338, the rear panel 338 is provided with an opening 340 having a flap 342 hingedly connected along its upper edge, such as by stitching 344, to an upper edge of opening 340. Second, the front panel 332 does not have an upper opening but is provided with a lower opening 346. Third, the top fabric 348 does not have any openings. However, the top fabric 348 still extends in a gradual slanting manner from a higher vertical level at the rear panel 338 down to a lower vertical level at the front panel 332 along stitch line 333.

Referring now to FIG. 14, a tube 335 extends from behind the opening 340 along the rear side 337 of rear panel 338, through an opening in the rear panel 338 below the top fabric 348, through the interior of the structure 330, and connects with the opening 346 of front panel 332. The tube 335 is similar to the tube 158 of structure 130 and may be made from the same materials. A foam pad 352 is hingedly connected to the rear side 337 of the rear panel 338. A tie member 354 connects the pad 352 to the rear panel 338, and acts to support the pad 352 so that it does not fold downwardly. The tube 335 is connected at its top end to the foam pad 352, and is connected at its bottom end to the opening 346. As a result, the pad 352 supports the tube 335 by holding the tube 335 in the deployed position shown in FIG. 14.

Therefore, a ball 350 tossed through the flap 342 of opening 340 will be collected in the tube 335 and delivered back to the player via opening 346, while a ball 350 that misses the flap 342 while staying within the confines of the structure 330 will roll down the top fabric 348 and come to rest against the interior side of the front panel 332.

The structure 330 may be folded and collapsed in the same manner as structure 130, except that the tube 335 is first collapsed against the rear panel 338 by releasing the tie member 354, folding the pad 352 downwardly or upwardly against the rear panel 338, and then optionally securing the pad 352 against the rear panel 338. The tie member 354 may be any conventional connection mechanism, and can include but is not limited to a spring tie and toggle, hooks, strings, or other removable connection mechanisms. In addition, although the top fabric 348 is shown as having both fabric and mesh, it is possible to provide the top fabric 348, or any of the panels 332, 334, 336 and 338, entirely of fabric or mesh, or of a combination of the two or any other material.

Figure 15:
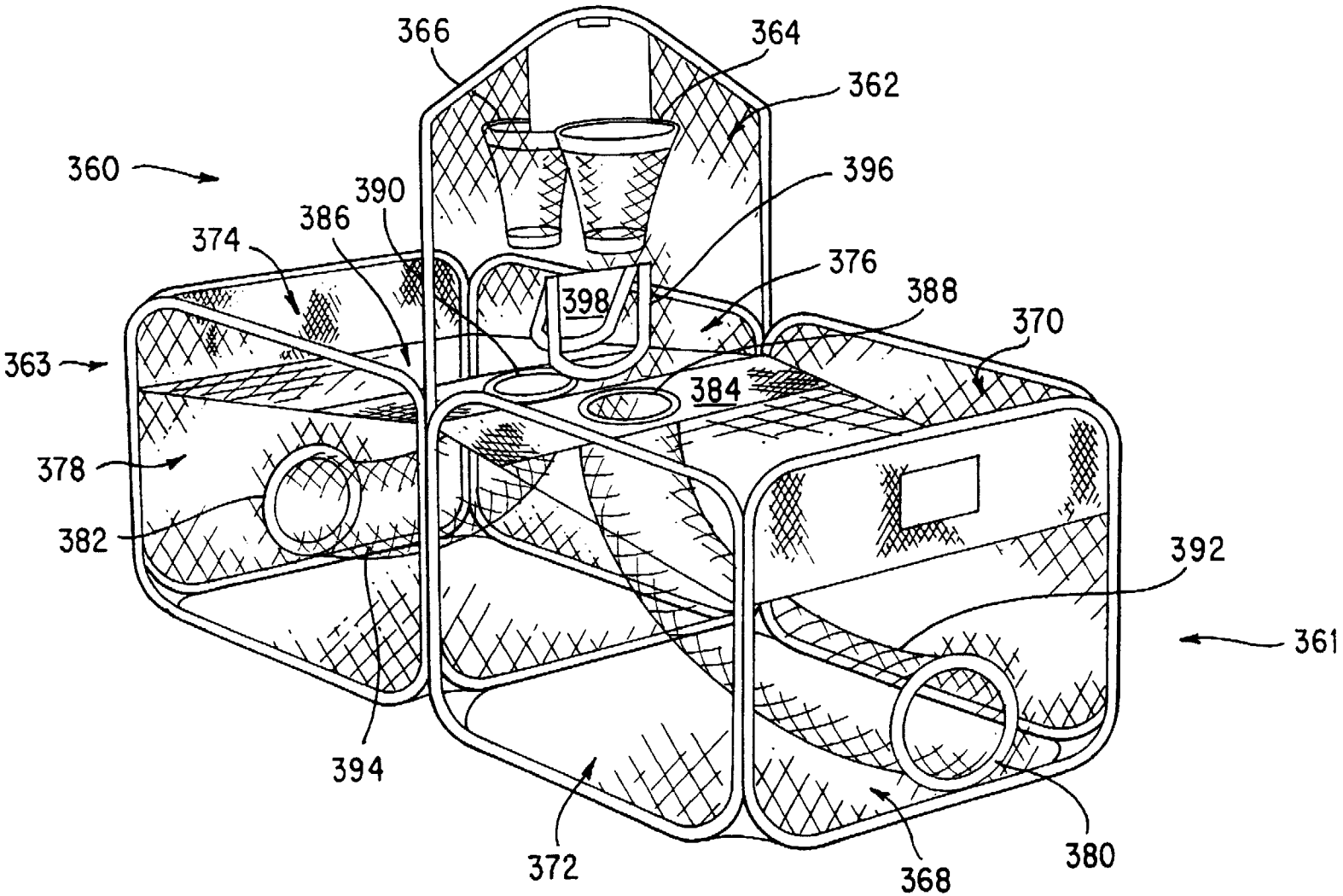
FIG. 15 is a perspective view of a collapsible structure according to a ninth preferred embodiment of the present invention where the structure provides a double-sided arcade basketball game.

FIG. 15 illustrates yet another arcade game structure 360 according to the present invention. Structure 360 is very similar to structure 130, except that the rear panel 362 now serves as the rear panel for two arcade games. Specifically, baskets 364 and 366 are provided on both sides of the rear panel 362, so that two basketball arcade games 361 and 363 are now provided by the structure 360, one on each side of the rear panel 362. Each side or game 361, 363 has three panels 368, 370, 372 and 374, 376, 378, respectively, which together with the rear panel 362, defines a structure that is essentially the same as structure 130. Openings 380 and 382 are likewise provided in the front panels 368 and 374, respectively. Slanted top fabrics 384 and 386 are also provided with openings 388 and 390, respectively, and tubes or nettings 392 and 394 connect openings 380, 388 and 382, 390, respectively. Openings 388 and 390 are aligned under baskets 364 and 366, respectively, so that balls tossed through baskets 364 and 366 will pass through openings 388 and 390, respectively, and tubes or nettings 392 and 394, respectively, and returned to the players via openings 380 and 382, respectively. Rear panel 362 additionally provides an opening 396 having a flap 398 hingedly connected along its upper edge to an upper edge of opening 396. Therefore, a player at one side 361 or 363 can toss a ball through the flap 398 of opening 396 to the other side 363 or 361.

To fold and collapse the structure 360, the panels on one side 361 or 363 are folded first against the rear panel 362, followed by the panels on the other side 363 or 361. The combined stack of panels are then collapsed. Specifically, panels 368 and 370 are pushed onto panels 372 and 362, respectively. The combined panels 368, 372 are then pushed against the combined panels 370, 362 to create a stack of four panels 362, 370, 368 and 372. Panels 374 and 376 are then pushed onto panels 378 and 362, respectively. The combined panels 374, 378 are then pushed against the combined panels 376, 362, 370, 368 and 372 to create a stack of seven panels, which are folded and collapsed in the manner shown in 8C–8E.

Figure 16A:
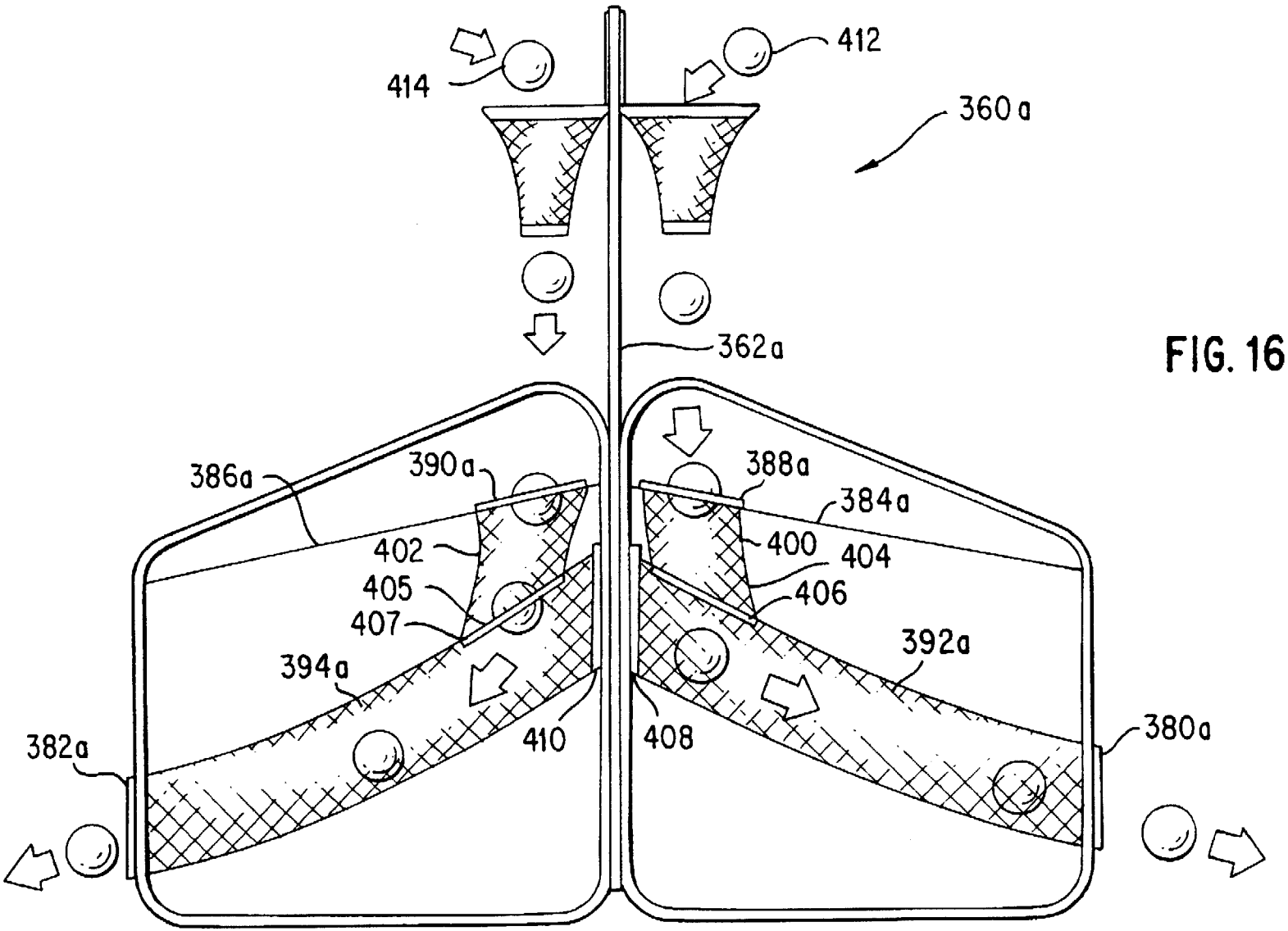
FIGS. 16A and 16B are cross-sectional views of the structure of FIG. 15 illustrating modifications of the tubes for delivering the ball back outside the structure.
Figure 16B:
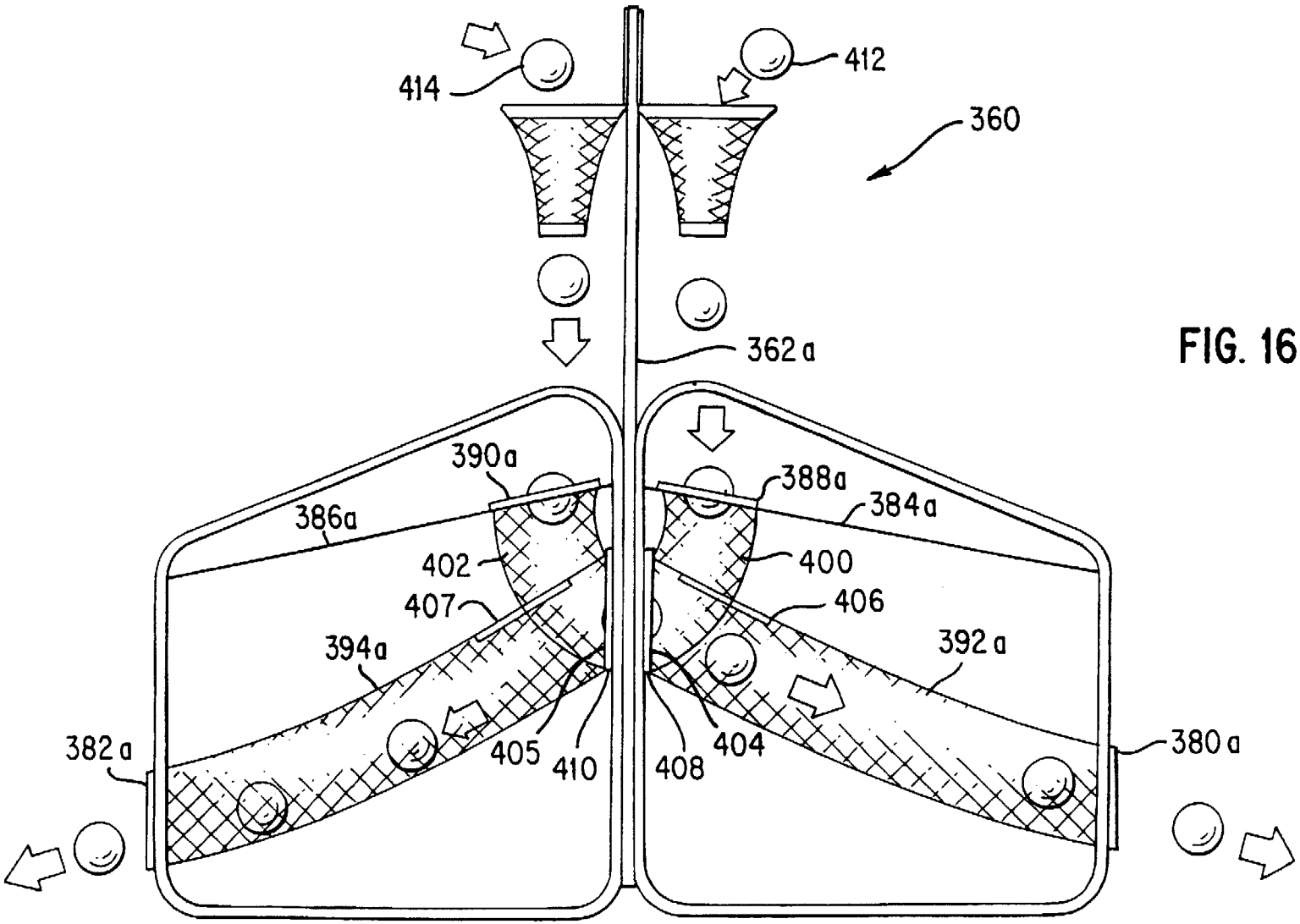

FIGS. 16A and 16B illustrate a modification **360*a* of the structure 360 in which tubes 392*a* and 394*a* can be manipulated to cause balls passing through openings 388*a* and 390*a* in top fabrics 384*a* and 386*a*, respectively, to be returned to the player at different openings 380*a* and 382*a***.

Each opening **388*a* and 390*a* on top fabrics 384*a* and 386*a* is provided with a flexible guide 400 and 402, respectively. The guides 400 and 402 can be made from the same materials as the tube 158 and which allows the guide 400 and 402 to be folded and collapsed together with the panels of the structure 360*a*. Each tube 392*a* and 394*a* has one end attached to an opening 380*a* and 382*a*, respectively, and an opposing end 408 and 410, respectively, that is attached to spaced-apart openings in the rear panel 362*a***.

In one mode of play illustrated in FIG. 16A, the exit opening 404 of guide 400 is removably connected to a cut-out or opening 406 in the tube **392*a* by using opposing Velcro pads, hooks, fasteners, and similar conventional attachment mechanisms. Similarly, the exit opening 405 of guide 402 is removably connected to a cut-out or opening 407 in the tube 394*a* by the same attachment mechanisms. In this mode of play, a ball 412 passing through opening 388*a* will be guided by the guide 400 through opening 406 and into tube 392*a*, to be returned to the player via opening 380*a*. Similarly, a ball 414 passing through opening 390*a* will be guided by the guide 402 through opening 407 and into tube 394*a*, to be returned to the player via opening 382*a***.

In another mode of play illustrated in FIG. 16B, the exit opening 404 of guide 400 is removably connected to the open end 410 of the tube **394*a* by using opposing Velcro pads, hooks, fasteners, and similar conventional attachment mechanisms. Similarly, the exit opening 405 of guide 402 is removably connected to the open end 408 in the tube 392*a* by the same attachment mechanisms. Openings 406 and 407 are not used. In this mode of play, a ball 412 passing through opening 388*a* will be guided by the guide 400 through open end 410 and into tube 394*a*, to be returned to the player via opening 382*a*. Similarly, a ball 414 passing through opening 390*a* will be guided by the guide 402 through open end 408 and into tube 392*a*, to be returned to the player via opening 380*a***.

The player can change between the two modes of play shown in FIGS. 16A and 16B by changing the position of the guides 400 and 402. For example, to change the position of the guide 400, the player reaches his or her hand through the opening **388*a* into the guide 400 and grasps the exit opening 404 to detach the existing connection. The exit opening 404 is then positioned at either the opening 406 or the open end 410 of tube 394*a* and attached thereto by attaching the connection mechanism. The guide 402 can be positioned in a similar manner, by reaching his or her hand through the opening 390*a* into the guide 402 and grasping the exit opening 405 to detach the existing connection. The exit opening 405 is then positioned at either the opening 407 or the open end 408 of tube 392*a*** and attached thereto by attaching the connection mechanism.

Thus, the structure **360*a* provides the player with an additional variety of play by allowing the player to choose the openings through which the ball will be directed. As further examples, it is possible to removably connect guide 400 to open end 410 of tube 394*a*, and guide 402 to opening 407, so that all balls passing through both openings 388*a* and 390*a* will be returned to the player via one opening 382*a*. Similarly, it is possible to removably connect guide 402 to open end 408 of tube 392*a*, and guide 400 to opening 406, so that all balls passing through both openings 388*a* and 390*a* will be returned to the player via one opening 380*a***.

Figure 17:
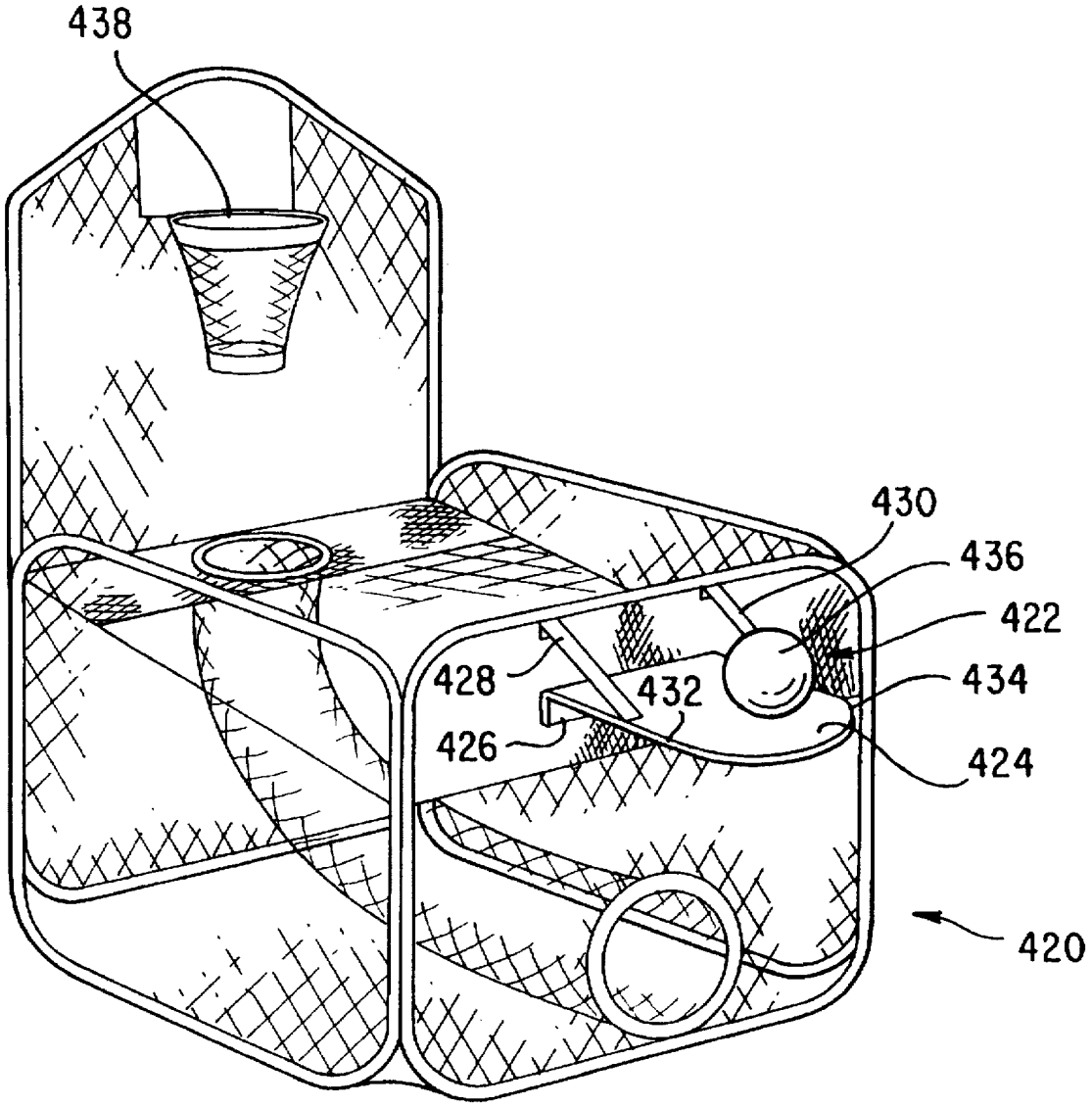
FIG. 17 is a perspective view of a collapsible structure according to a tenth preferred embodiment of the present invention which is a modification of the structure of FIG. 9.

FIG. 17 illustrates another embodiment of an arcade game structure 420 that includes another modification to the structure 130 in FIG. 9. The structure 420 is essentially the same as structure 130, except that the front panel 422 does not have an upper opening. In its place is provided a board or foam pad 424 having an edge 426 stitched or otherwise attached to the exterior surface of the front panel 422, with the stitching acting to hinge the board 424 for up and down movement about the stitching. A pair of elastic ties 428 and 430 support or suspend the two side edges 432 and 434 of the board 424 from the front panel 422 so that the board 424 normally assumes a position which is substantially horizontal with respect to the ground.

In use, a ball 436 is placed on the board 424, and the player presses the board 424 down and releases the board 424, so that the elasticity of the ties 428 and 430 will spring or bias the board 424 upwardly and eject the ball 436 towards the basket 438. After ejecting the ball 436, the bias of the ties 428 and 430 will bring the board 424 back to its normal horizontal position.

To open or deploy any of the collapsible structures of the present invention from their collapsed configurations, the user merely unfolds the plurality of concentric frame members from their collapsed state. The springy nature of the frame members will bias each frame member to return to its expanded configuration. The user then opens each panel away from the other panels to reassemble the structure into its expanded and deployed configuration.

In addition, it will be appreciated by those skilled in the art that any of the features shown in any of the embodiments of the present invention can be used in any of the other embodiments. As a non-limiting example, extended rear panels such as panel 190, and support panels such as support panel 191, illustrated in FIG. 10 can be used in any of the other embodiments. As a another non-limiting example, the structure can lengthened as shown in FIG. 12 by providing additional side panels and support panels such as panel 276. As a further non-limiting example, the board 424 shown in FIG. 17 can be used in any of the other embodiments.

Thus, the embodiments of FIGS. 9–17 provide arcade game structures which provide the player with an unlimited source and variety of fun and entertainment. The shapes and sizes of the panels and the structures can be varied or combined, as well as the entertainment features. These embodiments further illustrate the versatility of the basic module 20 of the present invention, in that this basic module 20 can be used to form the basis for numerous structures that offer an unlimited variety of entertainment and other purposes.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A collapsible structure adapted to be supported on a surface and comprising:

at least three foldable frame members, each having a folded and an unfolded orientation;

a fabric material substantially covering each frame member to form a panel for each frame member when the frame member is in the unfolded orientation, the fabric assuming the unfolded orientation of its associated frame member;

a top fabric connected to the panels and extending therebetween, the top fabric comprising a first opening;

wherein the structure includes a front panel and two side panels, the front panel having a first opening; and means for coupling the first opening of the top fabric with the first opening of the front panel.

2. The structure of claim 1, wherein each panel and its frame member comprises a left side, a right side, and a bottom side connecting the left side and the right side, and wherein the bottom side of each side panel is adapted to rest on the surface to support the play structure.

3. The structure of claim 2, wherein the left side of each panel is hingedly connected to the right side of an adjacent panel, and the right side of each panel is hingedly connected to the left side of another adjacent panel.

4. The structure of claim 3, wherein the left side and the right side of each panel are vertical when the frame member is in the unfolded orientation.

5. The structure of claim 1, wherein each panel further comprises a top edge, and wherein the top fabric is attached to the panels at a location offset from the top edge of the panels.

6. The structure of claim 5, further comprising a rear panel, and wherein the top fabric is slanted such that its attachment to the rear panel is at a higher vertical level than its attachment to the front panel.

7. The structure of claim 1, further comprising a first rear panel having an interior surface, and a basket attached to the interior surface of the rear panel and aligned with the first opening of the top fabric such that a ball that passes through the basket will be directed through the first opening of the top fabric.

8. The structure of claim 1, wherein the coupling means comprises a tube having opposing ends connected to the first opening in the front panel and the first opening of the top fabric.

9. The structure of claim 1, wherein the front panel further comprises an upper opening, and the top fabric further comprises a second opening communicating with the coupling means.

10. The structure of claim 7, further comprising a second rear panel attached to the two side panels, and wherein the first rear panel is removably attached to the second rear panel.

11. The structure of claim 10, further comprising a support panel attached to the first and second rear panels and a side panel.

12. The structure of claim 7, wherein the coupling means comprises a tube connected to the first opening in the front panel and a funnel attached to the first rear panel and connected to the tube.

13. The structure of claim 12, wherein the funnel further comprises a front edge coupled to the tube, a rear edge, and a ramp which slopes downwardly from its rear edge to its front edge.

14. The structure of claim 13, wherein the panels includes the front panel, the first rear panel, a front left side panel connected to the front panel, a front right side panel connected to the front panel, a rear left side panel connected to the first rear panel, and a rear right side panel connected to the first rear panel, with the front left side panel and the rear left side panel connected to each other, and the front right side panel and the rear right side panel connected to each other.

15. The structure of claim 14, further comprising a support panel connected to the connections between the front left side panel and the rear left side panel, and the front right side panel and the rear right side panel, the support panel comprising a window connected to the tube and the front edge of the ramp.

16. The structure of claim 1, wherein the top fabric further comprises a plurality of openings positioned adjacent to the first opening of the top fabric.

17. The structure of claim 1, wherein the front panel further comprises an exterior surface, and wherein the structure further comprises:

a board having an edge hingedly connected to the exterior surface of the front panel; and means for supporting the board in a position which is substantially horizontal to the surface, the supporting means operating to bias the board back to the substantially horizontal position after the board has been pressed and released.

18. A collapsible structure adapted to be supported on a surface and comprising:

at least three foldable frame members, each having a folded and an unfolded orientation; and a fabric material substantially covering each frame member to form a panel for each frame member when the frame member is in the unfolded orientation, the fabric assuming the unfolded orientation of its associated frame member;

wherein each panel comprises an exterior surface, with the panels connected together to define an enclosed space, and wherein the structure further comprises a basket attached to the exterior surface of one panel.

19. The structure of claim 18, further comprising a trough provided in one panel, wherein a ball tossed through the trough will deposit inside the structure.

20. The structure of claim 19, further comprising an opening provided in one panel for ingress and egress to the interior of the structure.

21. A collapsible structure adapted to be supported on a surface and comprising:

at least three foldable frame members, each having a folded and an unfolded orientation; and a fabric material substantially covering each frame member to form a panel for each frame member when the frame member is in the unfolded orientation, the fabric assuming the unfolded orientation of its associated frame member;

wherein the structure includes a front panel, two side panels, and a rear panel having an opening and an exterior surface facing away from the interior of the structure, the front panel having an opening; and a tube having a first end connected to the exterior surface of the rear panel adjacent the opening of the rear panel and extending through the interior of the structure with a second end connected to the opening of the front panel.

22. The structure of claim 21, further comprising a flap hingedly connected at the opening of the rear panel.

23. The structure of claim 21, further comprising a pad hingedly attached to the exterior surface of the rear panel and attached to the first end of the tube.

24. A collapsible structure adapted to be supported on a surface and comprising:

at least three foldable frame members, each having a folded and an unfolded orientation;

a fabric material substantially covering each frame member to form a panel for each frame member when the frame member is in the unfolded orientation, the fabric assuming the unfolded orientation of its associated frame member;

wherein the panels include a rear panel having a first side and an opposing second side, a first front panel and two first side panels attached to the first side of the rear panel, and a second front panel and two second side panels attached to the second side of the rear panel, wherein the first front panel and the second front panel each comprises an opening;

a first top fabric connected to the panels on the first side of the rear panel and extending therebetween, the first top fabric comprising an opening;

a second top fabric connected to the panels on the second side of the rear panel and extending therebetween, the second top fabric comprising an opening; and means for coupling one of the openings of the first top fabric or the second top fabric with the opening of the first front panel.

25. The structure of claim 24, wherein the means for coupling one of the openings of the first top fabric or the second top fabric with the opening of the first front panel comprises:

a guide positioned at the opening of the first top fabric; and a first tube having one end connected to the opening of the first front panel and an opening for receiving the guide.

26. The structure of claim 24, wherein the means for coupling one of the openings of the first top fabric or the second top fabric with the opening of the first front panel comprises:

a guide positioned at the opening of the second top fabric; and a first tube having one end connected to the opening of the first front panel and an opposing end for receiving the guide.

27. The structure of claim 24, further comprising means for coupling one of the openings of the first top fabric or the second top fabric with the opening of the second front panel.

28. The structure of claim 27, wherein the means for coupling one of the openings of the first top fabric or the second top fabric with the opening of the second front panel comprises:

a guide positioned at the opening of the second top fabric; and a second tube having one end connected to the opening of the second front panel and an opening for receiving the guide.

29. The structure of claim 27, wherein the means for coupling one of the openings of the first top fabric or the second top fabric with the opening of the second front panel comprises:

a guide positioned at the opening of the first top fabric; and a second tube having one end connected to the opening of the second front panel and an opposing end for receiving the guide.

30. The structure of claim 24, further comprising:

a first basket attached to the first side of the rear panel and substantially aligned with the opening of the first top fabric; and a second basket attached to the second side of the rear panel and substantially aligned with the opening of the second top fabric.

* * * * *